US008237637B2

(12) United States Patent
Chung

(10) Patent No.: US 8,237,637 B2
(45) Date of Patent: Aug. 7, 2012

(54) ORGANIC LIGHT EMITTING DISPLAY AND DRIVING METHOD THEREOF

(75) Inventor: Boyong Chung, Yongin-si (KR)

(73) Assignee: Samsung Mobile Display Co., Ltd., Suwon-si, Gyeonggi-do (KR)

( * ) Notice: Subject to any disclaimer, the term of this patent is extended or adjusted under 35 U.S.C. 154(b) by 1068 days.

(21) Appl. No.: 12/003,148

(22) Filed: Dec. 20, 2007

(65) Prior Publication Data

US 2008/0150846 A1 Jun. 26, 2008

(30) Foreign Application Priority Data

Dec. 21, 2006 (KR) ..... 10-2006-0131962

(51) Int. Cl.
*G09G 3/30* (2006.01)

(52) U.S. Cl. ..... 345/80; 345/76

(58) Field of Classification Search ..... 345/80, 345/82, 39, 44; 250/552
See application file for complete search history.

(56) References Cited

U.S. PATENT DOCUMENTS

| | | | | |
|---|---|---|---|---|
| 7,564,452 | B2 * | 7/2009 | Komiya | 345/204 |
| 2004/0070557 | A1 * | 4/2004 | Asano et al. | 345/76 |
| 2005/0017934 | A1 | 1/2005 | Chung et al. | |
| 2005/0168415 | A1 | 8/2005 | Noda et al. | |
| 2006/0103611 | A1 | 5/2006 | Choi | |
| 2006/0125737 | A1 | 6/2006 | Kwak et al. | |
| 2006/0170628 | A1 | 8/2006 | Yamashita et al. | |
| 2006/0244695 | A1 | 11/2006 | Komiya | |
| 2006/0279478 | A1 | 12/2006 | Ikegami | |
| 2007/0030219 | A1 | 2/2007 | Park et al. | |

FOREIGN PATENT DOCUMENTS

| | | | |
|---|---|---|---|
| JP | 2006-309119 | A | 11/2006 |
| KR | 10-2005-0005646 | A | 1/2005 |
| KR | 10-2005-0077765 | A | 8/2005 |
| KR | 10-2006-0019757 | A | 3/2006 |
| KR | 10-2006-0053693 | A | 5/2006 |
| KR | 10-2006-0088828 | A | 8/2006 |
| KR | 10-2006-0114456 | A | 11/2006 |
| KR | 10-2006-0115203 | A | 11/2006 |
| KR | 10-2006-0128656 | A | 12/2006 |

OTHER PUBLICATIONS

Japanese Office Action in JP 2011-020824, dated Dec. 13, 2011 (Chung).

* cited by examiner

*Primary Examiner* — Kevin M Nguyen
*Assistant Examiner* — Kenneth B Lee, Jr.
(74) *Attorney, Agent, or Firm* — Lee & Morse, P.C.

(57) ABSTRACT

An organic light emitting display including a scan signal line forwarding a scan signal, a data line sending a data signal and a pixel coupled to the scan signal line and the data line, the organic light emitting diode display, wherein the pixel includes a first switching transistor transmitting a data signal from the data line in response to the scan signal of the scan signal line, a driving transistor, coupled to the first switching transistor, controlling driving current from a first power source line, a storage capacitor coupled between the driving transistor and the first power source line, an organic light emitting diode, coupled between the driving transistor and a second power source line, displaying an image with the driving current controlled by the driving transistor, an initial switching transistor, coupled between the storage capacitor and an initial power source line, initializing the storage capacitor, and a switching transistor for applying a reverse bias, coupled between the second power source line and the initial power source line, applying a reverse bias voltage to the organic light emitting diode.

34 Claims, 11 Drawing Sheets

ORGANIC LIGHT EMITTING DISPLAY AND DRIVING METHOD THEREOF

CROSS-REFERENCE TO RELATED APPLICATIONS

This application claims the benefit of Korean Patent Application No. 10-2006-0131962 filed on Dec. 21, 2006, in the Korean Intellectual Property Office, the disclosure of which is incorporated herein by reference.

BACKGROUND

1. Field of the Invention

The present invention relates to an organic light emitting display and a driving method thereof and, more particularly, to an organic light emitting display and a driving method thereof that ensure an operation margin of a driving circuit when driving a large-size panel by applying an interlaced scanning method, prevent a voltage drop (IR-drop) of a first power source line VDD and, simultaneously, minimize degradation of the organic light emitting diode OLED in a pixel circuit of the organic light emitting display by dividing a data write period from a light emission period in driving the panel.

2. Discussion of Related Art

Recently, the organic light emitting display has attracted attention as the next generation flat panel display due to its advantages such as a thin thickness, a wide viewing angle, a high response rate, etc. Such an organic light emitting display controls the amount of current flowing in the organic light emitting diodes of the respective pixels to control the brightness of the respective pixels, thus displaying an image. That is, a current corresponding to a data voltage is supplied to the organic light emitting diode and thereby the organic light emitting diode emits light correspondingly to the supplied current. Here, the data voltage applied has multilevel values in a predetermined range so as to express gradation.

If a thin film transistor TFT using amorphous silicon (a-si) is used as a driving transistor, the current driving capability is relatively low; however, it has advantages in that the uniformity of the display device is excellent and it is more favorable to a large-size process.

As driving methods for driving such an organic light emitting diode display, there are a progressive scanning method and an interlaced scanning method. The progressive scanning method drives scan lines in sequence from top left to bottom right of a screen, in which an image is displayed on all horizontal lines in one frame at one time.

The interlaced scanning method displays only the half of the horizontal lines in one image frame and this method may scan an image by dividing one image frame into two fields (odd and even) or may scan an image by dividing two frames into a first frame (odd) and a second frame (even).

If using the progressive scanning method, it has an advantage in that it provides an excellent image quality in a static screen; however, it also has drawbacks in that it is difficult to ensure an operation margin of a driving circuit when driving a large-size panel, since its scanning rate is no more than half that of the interlaced scanning method. Moreover, the progressive scanning method has drawbacks in that it may cause a voltage drop (IR-drop) as a first power source line VDD passes through the respective pixel circuits, thus decreasing the brightness of the pixels gradually. Furthermore, in the general organic light emitting diode display, as current flows in one direction from an anode to a cathode of the organic light emitting diode OLED, space charges are stored between a hole transport layer HTL and an emitting layer EML or between an electron transport layer ETL and an emitting layer EML. Due to the accumulation of the space charges, the current IOLED flowing in the organic light emitting diode OLED may be dropped. Accordingly, as the brightness of the respective pixels may be decreased, the brightness of the organic light emitting display applying the pixel circuits is lowered gradually with time. Furthermore, the lifespan of the organic light emitting display may be shortened. In addition, due to the difference of the degradation degrees of the organic light emitting diodes in the respective pixel circuits, the brightness of the whole organic light emitting display becomes non-uniform as a result.

SUMMARY OF THE INVENTION

The present invention has been contrived to solve the conventional problems as described above, and an aspect of the present invention is to ensure an operation margin of a driving circuit when driving a large-size panel by applying an interlaced scanning method and prevent a voltage drop (IR-drop) of a first power source line VDD by dividing the data write period from the light emission period in driving the panel.

Another aspect of the present invention is to provide an organic light emitting display and a driving method thereof that reduce degradation of an organic light emitting diode by applying a reverse bias voltage to the organic light emitting diode and increase the lifespan of the organic light emitting diode and the uniformity of brightness of the respective pixels by the elimination of the degradation.

Still another aspect of the present invention is to compensate the non-uniformity and the variation of threshold voltages of semiconductor elements by applying a threshold voltage Vth compensation circuit.

To solve the above-described problems, there is provided an organic light emitting display in accordance with a exemplary embodiment of the present invention may include: a scan signal line forwarding a scan signal, a data line sending a data signal and a pixel coupled to the scan signal line and the data line, the organic light emitting diode display, wherein the pixel includes: a first switching transistor transmitting a data signal from the data line in response to the scan signal of the scan signal line; a driving transistor, coupled to the first switching transistor, controlling driving current from a first power source line; a storage capacitor coupled between the driving transistor and the first power source line; an organic light emitting diode, coupled between the driving transistor and a second power source line, displaying an image with the driving current controlled by the driving transistor; an initial switching transistor, coupled between the storage capacitor and an initial power source line, initializing the storage capacitor; and a switching transistor for applying a reverse bias, coupled between the second power source line and the initial power source line, applying a reverse bias voltage to the organic light emitting diode.

Moreover, an organic light emitting display in accordance with another embodiment of the present invention may include: a scan signal line forwarding a scan signal, a data line-sending a data signal and a pixel coupled to the scan signal line and the data line, the organic light emitting diode display, wherein the pixel includes: a first switching transistor transmitting a data signal from the data line in response to the scan signal of the scan signal line; a driving transistor, coupled to the first switching transistor, controlling driving current from a first power source line; a storage capacitor coupled between the driving transistor and the first power source line; an organic light emitting diode, coupled between the driving transistor and a second power source line, displaying an image with the driving current controlled by the driving transistor; an initial switching transistor, coupled between the storage capacitor and an initial power source line, initializing the storage capacitor; and a switching transistor for applying a reverse bias, coupled between the second power source line and the initial power source line, applying a reverse bias voltage to the organic light emitting diode, wherein the respective pixels are classified into an odd line and an even line in the horizontal direction and driving periods of the pixels on the odd and even lines are classified into a storage period for storing a data voltage and a threshold voltage of the driving transistor and a light emission period.

Furthermore, a driving method of an organic light emitting display in accordance with another embodiment of the present invention, wherein all pixels in a panel (an image display unit) may be classified into an odd line and an even line in the horizontal direction; a first power source line for the odd line may be coupled to the pixels on the odd line, a first power source line for the even line may be coupled to the pixels on the even line, the driving method may repeatedly execute a first frame period and a second frame period to display an image, wherein, in the first frame period, the pixel on the even (or odd) line writes data and, simultaneously, applies a reverse bias voltage to the organic light emitting diode, while the pixel on the odd (or even) line emits light and, in the second frame period, the pixel on the even (or odd) line emits light, while the pixel on the odd (or even) line writes data and, simultaneously, applies a reverse bias voltage to the organic light emitting diode.

DETAILED DESCRIPTION OF PREFERRED EMBODIMENTS

Figure 1:
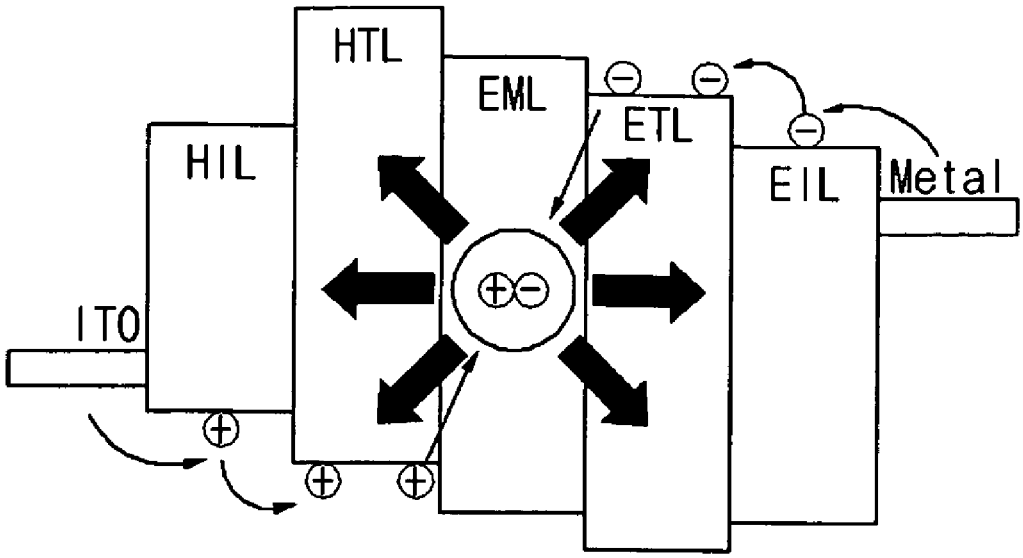
FIG. 1 is a schematic diagram depicting a basic structure of a general organic light emitting diode.

The present invention now will be described more fully hereinafter with reference to the accompanying drawings, in which exemplary embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those having skill in the art.

For the purpose of explaining the present invention explicitly, the portions unrelated to the present invention are omitted in the drawings. Throughout the specification of the present invention, the elements having the same configuration and operation are denoted by the same reference numerals. Supposed that a certain portion is coupled to another portion, it includes the case where it is connected to the same via a different element as well as the case where it is directly connected to the same.

In general, the organic light emitting display panel expresses an image by voltage-driving or by current-driving the organic light emitting cells of N×M arranged in the form of a matrix.

The organic light emitting diode having diode characteristics (generally called the OLED) includes an anode (ITO), an organic thin film (organic layer) and a cathode (metal) as depicted in FIG. 1. The organic thin film may include a multilayered structure including an emitting layer EML, an electron transport layer ETL transporting electrons and a hole transport layer HTL transporting holes to ensure the balance of holes, thus improving the luminescent efficiency. Moreover, an electron injecting layer EIL injecting electrons may be further established on one side of the electron transport layer and a hole injecting layer injecting holes may be also further established on one side of the hole transport layer. Furthermore, in case of a phosphorescent organic light emitting diode, a hole blocking layer HBL may be selectively formed between the emitting layer EML and the electron transport layer ETL and an electron blocking layer EBL may be selectively arranged between the emitting layer EML and the hole transport layer HTL. In addition, the organic thin film (organic layer) may be formed in a slim organic light emitting diode structure in which two kinds of layers are mixed with each other, thus reducing the thickness. For example, a hole injection transport layer HITL structure, in which the hole injecting layer HIL, and the hole transport layer HTL are simultaneously established, and an electron injection transport layer EITL, in which the electron injecting layer EIL and the electron transport layer ETL are simultaneously formed, may be selectively provided. The slim organic light emitting diode aims at improving the luminescent efficiency. A buffer layer may be selectively formed between the anode and the emitting layer EML. The buffer layer may be classified into an electron buffer layer buffering electrons and a hole buffer layer buffering holes. The electron buffer layer may be selectively formed between the cathode and the electron injecting layer EIL and established on behalf of the function of the electron injecting layer EIL. Here, a stack structure of the organic thin film may be emitting layer EML/electron transport layer ETL/electron buffer layer/cathode. The hole buffer layer may be selectively established between the anode and the hole injecting layer EIL and provided on behalf of the function of the hole injecting layer HIL. Here, a stack structure of the organic thin film may be anode/hole buffer layer/hole transport layer HTL/emitting layer EML.

Figure 2:
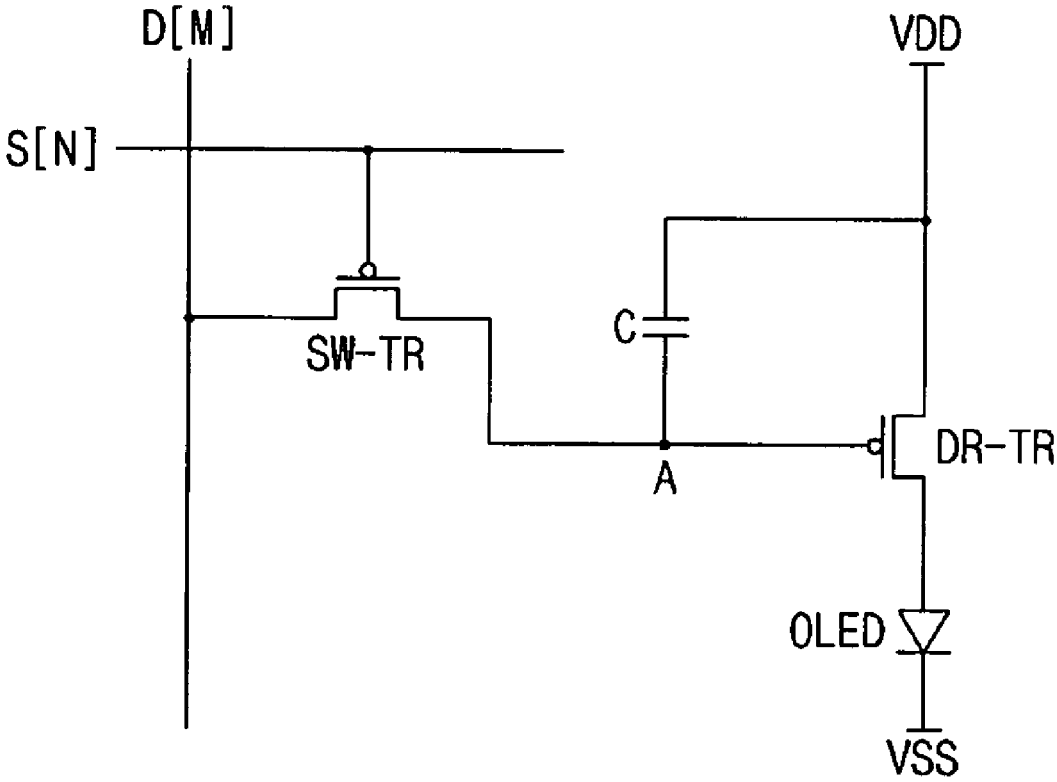
FIG. 2 is a schematic diagram depicting a basic pixel circuit of a voltage driving method.
Figure 3:
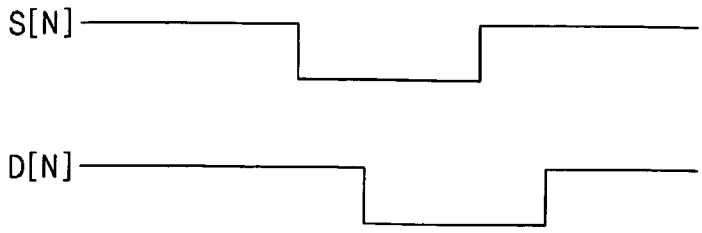
FIG. 3 is a driving timing diagram of the pixel circuit depicted in FIG. 2.

As driving methods for driving the above-described organic light emitting diode, a passive matrix method and an active matrix method are widely known. The passive matrix method has advantages in that the manufacturing process is simple and the investment cost is low by arranging the anode and the cathode orthogonally and selectively driving the lines; however it has a drawback in that the current consumption is increased when applied to a large-size display. The active matrix driving method has advantages in that the current consumption is low, it provides an excellent image quality and a long lifespan and it is possible to readily fabricate medium and large-size display by establishing an active element and a storage capacitor like a thin film transistor in the respective pixels. As described above, a pixel circuit configuration based on the organic light emitting diode and the thin film transistor is necessary in the active matrix method. Here, as the thin film transistor, an amorphous silicon thin film transistor or a polycrystalline silicon thin film transistor is applied thereto. Referring to FIG. 2, a pixel circuit of an organic light emitting display is depicted. FIG. 3 shows a driving timing diagram of the pixel circuit depicted in FIG. 2. Such a pixel circuit is directed to an exemplary one of the pixel circuits of an N×M number. As depicted in FIG. 2, the pixel circuit of the organic light emitting display includes a scan signal line S[N] supplying a scan signal, a data signal line D[M] supplying a data signal, a first power source line VDD supplying a first power voltage, a second power source line VSS supplying a second power voltage, a driving transistor DR_TR, a switching transistor SW_TR, a storage capacitor C and an organic light emitting diode OLED. Here, the first power voltage may have a level higher than that of the second power voltage.

The operation of the above-described pixel circuit for one frame will be described with reference to FIG. 3.

As shown in FIG. 3, a scan signal is supplied and then a data signal is supplied for a slight time difference. The reason of the slight time difference is to ensure a margin from the time that the switching transistor is turned on by the supplied scan signal to the time that the data signal is supplied. Describing the pixel circuit of FIG. 2 based on the timing diagram of FIG. 3, if a scan signal is supplied from the scan signal line S[N], the switching transistor SW_TR is turned on. Accordingly, a data signal (voltage) from the data line D[M] is supplied to a control electrode of the driving transistor DR_TR and a first electrode A of the storage capacitor C.

Accordingly, as a first power voltage from the first power source line VDD is supplied to the organic light emitting diode OLED through the driving transistor DR_TR, the organic light emitting diode OLED emits light at a predetermined brightness for one frame. Since the data voltage supplied from the data line D[M] is stored in the storage capacitor C, the driving transistor DR_TR is kept in a turned-on state for one frame, even though the scan signal from the scan signal line S[N] is cut off.

Moreover, current in a forward direction from the anode to the cathode is continuously applied to the organic light emitting diode as the frames proceed. That is, if current flows in the organic light emitting diode in one direction from the anode to cathode, space charges are stored between a hole transport layer HTL and an emitting layer EML or between an electron transport layer ETL and an emitting layer EML of the organic thin film. Due to the accumulation of the space charges, the current IOLED flowing in the organic light emitting diode OLED may be dropped. Accordingly, as the brightness of the respective pixels may be decreased, the brightness of the organic light emitting display applying the pixel circuits is lowered gradually with time. Furthermore, the lifespan of the organic light emitting display may be shortened, and due to the difference of the degradation degrees of the organic light emitting diodes in the respective pixel circuits, the brightness of the whole organic light emitting display becomes non-uniform as a result.

Moreover, if driving the organic light emitting display in the progressive scanning method, it may cause a problem in ensuring an operation margin of the driving circuit when driving a large-size panel. Furthermore, if driving the organic light emitting display using one first power source line VDD in the progressive scanning method, the first power source line VDD is coupled to the organic light emitting display through the respective pixel circuits and thereby it causes a problem in that the brightness is decreased as it goes far from the first power source line VDD.

Figure 4:
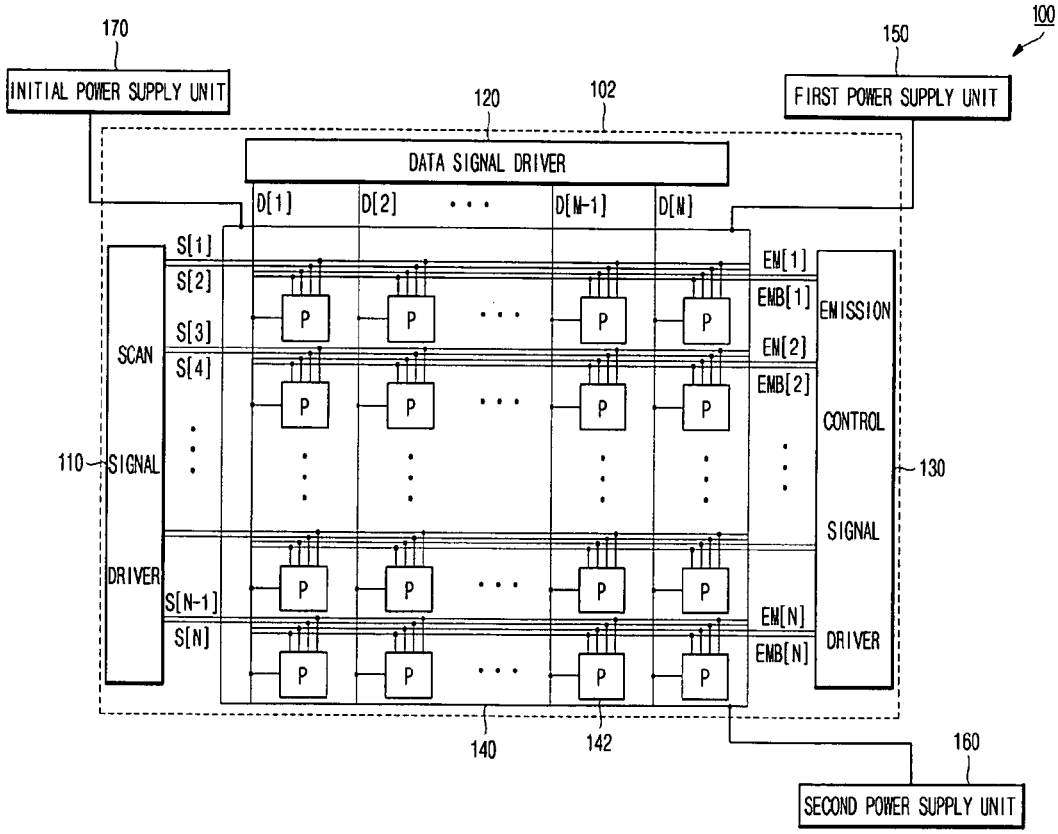
FIG. 4 is a block diagram depicting a basic structure of an organic light emitting display in accordance with the present invention driven in a progressive scanning method.

Referring to FIG. 4, a basic structure diagram of an organic light emitting display in accordance with the present invention driven in a progressive scanning method is depicted.

As depicted in FIG. 4, an organic light emitting display 100 may include a scan signal driver 110, a data signal driver 120, an emission control signal driver 130, an organic light emitting display panel 140 (hereinafter referred to as the panel 140), a first power supply unit 150, a second power supply unit 160, and an initial power supply unit 170.

The scan signal driver 110 may supply scan signals to the panel 140 in sequence through a plurality of scan signal lines S[1] to S[N].

The data signal driver 120 may supply data signals to the panel 140 through a plurality of data signal lines D[1] to D[M].

The emission control signal driver 130 may in sequence supply an emission control signal and an emission reverse control signal to the panel 140 through a plurality of emission control signal lines EM[1] to EM[N] and a plurality of emission reverse control signal lines EMB[1] to EMB[N]. Moreover, the panel 140 may include a plurality of scan signal lines S[1] to S[N], a plurality of emission control signal lines EM[1] to EM[N] and a plurality of emission reverse control signals EMB[1] to EMB[N], arranged in the vertical direction, a plurality of data signal lines D[1] to D[M] arranged in the horizontal direction, and a plurality of pixel circuits 142 defined by the scan signal lines S[1] to S[N], the emission control signal lines EM[1] to EM[N], the emission reverse control signal lines EMB[1] to EMB[N] and the data signal lines D[1] to D[M].

Here, the pixel circuit 142 may be formed in a pixel area defined by the scan line and the data line. Of course, as described above in detail, the scan signals may be supplied from the scan signal driver 110 to the scan signal lines S[1] to S[N], the data voltages may be supplied from the data signal driver 120 to the data signal lines D[1] to D[M], and the emission control signals and the emission reverse control signals may be supplied from the emission control signal driver 130 to the emission control signal lines EM[1] to EM[N] and the emission reverse control signal lines EMB[1] to EMB[N].

Moreover, the first power supply unit 150, the second power supply unit 160 and the initial power supply unit 170 supply a first power voltage, a second power voltage and an initial power voltage to the pixel circuits 142, respectively.

As depicted in FIG. 4, the scan signal driver 110, the data signal driver 120, the emission control signal driver 130, the panel 140, the first power supply unit 150, the second power supply unit 160 and the initial power supply unit 170 may be arranged all on a single substrate 102.

Especially, the drivers 110, 120 and 130 and the power supply units 150, 160 and 170 may be established on the identical layer where the scan signal lines S[1] to S[N], the data signal lines D[1] to D[M], the emission control signal lines EM[1] to EM[N], the emission reverse control signal lines EMB[1] to EMB[N] and the pixel circuits 142 are established.

It is possible to form the drivers 110, 120 and 130 and the power supply units 150, 160 and 170 on a separate substrate, not depicted, different from the substrate 102, and electrically connect the substrate with the substrate 102. Furthermore, the drivers 110, 120 and 130 and the power supply units 150, 160 and 170 may be arranged in a form selected from the group consisting of a tape carrier package TCP, a flexible printed circuit FPC, a tape automatic bonding TAB, a chip on glass COG and an equivalent thereof coupled to the substrate 102; however, the form and the position of the drivers 110, 120 and 130 and the power supply units 150, 160 and 170 are not limited thereto in the present invention.

Figure 5:
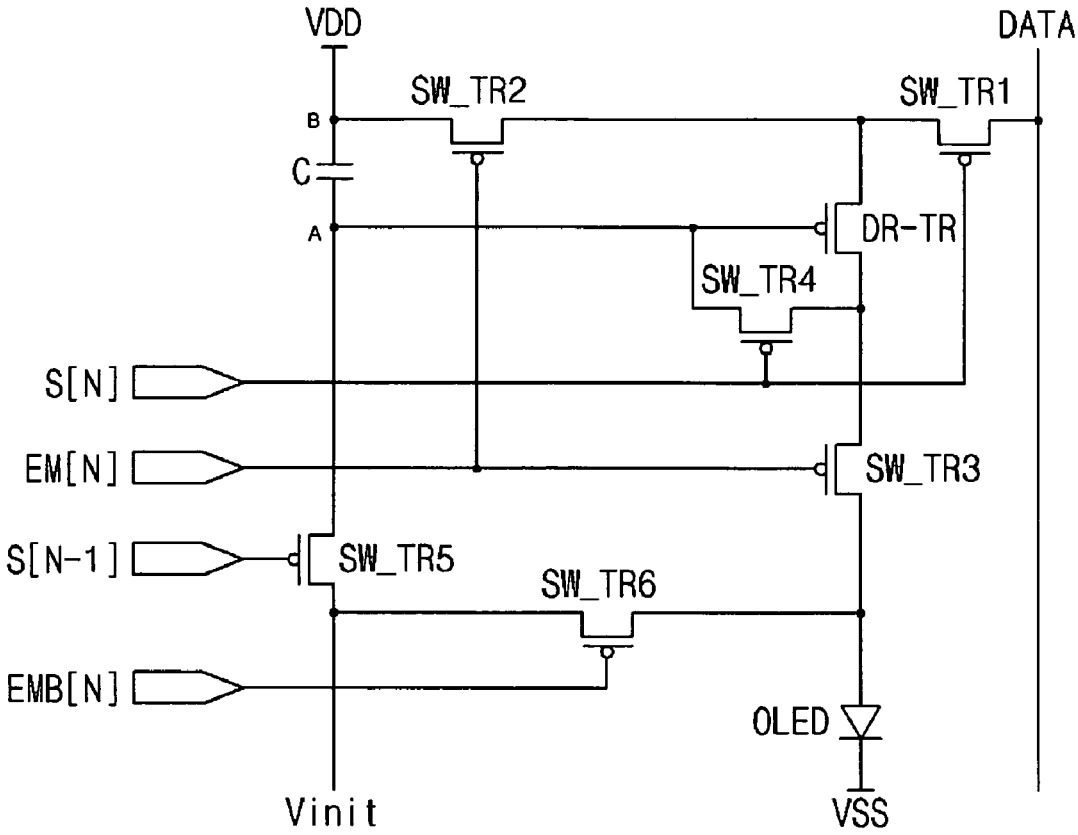
FIG. 5 is a circuit diagram depicting a pixel circuit of an organic light emitting display in accordance with a exemplary embodiment of the present invention.

Referring to FIG. 5, a circuit diagram depicting a pixel circuit of an organic light emitting display in accordance with an exemplary embodiment of the present invention is depicted. The pixel circuit described below denotes one of the pixel circuits in the organic light emitting display 100 depicted in FIG. 4. As depicted in FIG. 5, the pixel circuit of the organic light emitting display in accordance with the present invention may include a scan signal line S[N], a previous scan signal line S[N−1], a data signal line D[M], an emission control signal line EM[N], an emission reverse control signal line EMB[N], a first power source line VDD, a second power source line VSS, a first switching transistor SW_TR1, a second switching transistor SW_TR2, a third switching transistor SW_TR3, a fourth switching transistor SW_TR4, a driving transistor DR_TR, an initial switching transistor SW_TR5, a switching transistor SW_TR6 for applying a reverse bias and a storage capacitor C.

The scan signal line S[N] supplies a scan signal for selecting an organic light emitting diode OLED to be turned on to a control electrode of the first switching transistor SW_TR1.

Moreover, the scan signal line S[N] supplies a scan signal to a control electrode of the fourth switching transistor SW_TR4 so that the fourth switching transistor SW_TR4 may be coupled to a gate and a drain of the driving transistor DR_TR to be diode-like connected thereto. The scan signal line S[N] may be coupled to the scan signal driver 110 generating scan signals (See FIG. 4).

The previous scan signal line S[N−1] supplies a previous scan signal to a control electrode of the initial switching transistor SW_TR5. The initial switching transistor SW_TR5 is configured to be coupled to the initial power source line Vinit, the storage capacitor C and a control electrode of the driving transistor DR_TR, thus initializing the storage capacitor C and the control electrode of the driving transistor DR_TR. The previous scan signal line S[N−1] may be coupled to the scan signal driver 110 generating scan signals (See FIG. 4).

The data signal line D[M] supplies a data signal (voltage) in proportion to a luminescent brightness to a first electrode A of the storage capacitor C and the driving transistor DR_TR. The data signal line D[M] may be coupled to the data signal driver 120 generating data signals (See FIG. 4).

The emission control signal line EM[N], coupled to the second switching transistor SW_TR2 and the third switching transistor SW_TR3, supplies an emission control signal. If the second switching transistor SW_TR2 and the third switching transistor SW_TR3 are turned on by the emission control signal, a current corresponding to the data signal stored in the storage capacitor C may be applied from the first power source line VDD to the organic light emitting diode OLED through the driving transistor DR_TR. Accordingly, the organic light emitting diode OLED can emit light. The emission control signal line EM[N] may be coupled to the emission control signal driver 130 generating emission control signals (See FIG. 4).

The emission reverse control signal line EMB[N] supplies a signal of low level to a control electrode the switching transistor SW_TR6 for applying a reverse bias when the emission control signal is high level. If the switching transistor SW_TR6 for applying a reverse bias is turned on by the emission reverse control signal, a reverse bias voltage may be applied to the organic light emitting diode OLED. The emission reverse control signal line EMB[N] may be coupled to the emission control signal driver 130 generating emission control signals (See FIG. 4). Substantially, the emission reverse control signal may be readily obtained by coupling an inverter to a previous end of an output end of the emission control signal driver outputting the emission control signal.

The first power source line VDD serves to supply a first power voltage to the organic light emitting diode OLED. The first power source line VDD may be coupled to the first power supply unit 150 supplying the first power voltage (See FIG. 4).

The second power source line VSS serves to supply a second power voltage to the organic light emitting diode OLED. The second power source line VSS may be coupled to the second power supply unit 160 supplying the second power voltage (See FIG. 4). Here, the first power voltage may be high level compared with the second power voltage.

Moreover, as the second power voltage, a ground voltage may be used.

The initial power source line Vinit initializes the storage capacitor C and the control electrode of the driving transistor DR_TR. The initial power source line Vinit may be coupled to the initial power supply unit 170 supplying the initial power voltage (See FIG. 4).

A first electrode (source electrode or drain electrode) of the first switching transistor SW_TR1 is coupled to the data signal line D[M], a second electrode thereof (drain electrode or source electrode) may be coupled to a first electrode (source electrode or drain electrode) of the driving transistor DR_TR and a control electrode thereof (gate electrode) may be coupled to the scan signal line S[N]. Such a first switching transistor SW_TR1 may be a P-channel transistor. The first switching transistor SW_TR1 is turned on, if a scan signal of low level is applied to the control electrode thereof through the scan signal line S[N], to supply a value subtracting a threshold voltage Vth of the driving transistor from the data voltage to the first electrode A of the storage capacitor C.

A first electrode of the driving transistor DR_TR is coupled to the second electrode of the first switching transistor SW_TR1, a second electrode thereof is coupled to a first electrode of the third switching transistor SW_TR3, and a control electrode thereof may be coupled to a second electrode of the fourth switching transistor SW_TR4 and a first electrode A of the storage capacitor C. Such a driving transistor DR_TR may be a P-channel transistor. The driving transistor DR_TR is turned on, if a signal of low level is applied to the control electrode thereof, and supplies current of a predetermined amount from the first power source line VDD to the organic light emitting diode OLED. Since the data signal is supplied to the first electrode A of the storage capacitor C to charge the same, the signal of low level is applied to the control electrode of the driving transistor DR_TR continuously by the charged voltage of the storage capacitor C for a predetermined time, even if the first switching transistor SW_TR1 is turned off. Here, the driving transistor DR_TR may be one selected from the group consisting of an amorphous silicon thin film transistor, a polysilicon thin film transistor, an organic thin film transistor, a nano thin film transistor and an equivalent thereof; however, the material or the kind thereof are not limited thereto.

Moreover, if the driving transistor DR_TR is the polysilicon thin film transistor, it may be fabricated through a process selected from the group consisting of a laser crystallization, a metal-induced crystallization, a high-pressure crystallization and an equivalent thereof; however, the process of fabricating the polysilicon thin film transistor is not limited thereto in the present invention. The laser crystallization is directed to a process in which an excimer laser, for example, is irradiated to an amorphous silicon to be crystallized, the metal-induced crystallization is a process in which a metal is positioned on the amorphous silicon and a predetermined heat, for example, is applied thereto to cause the crystallization of the metal, and the high-pressure crystallization is a process in which a predetermined pressure, for example, is applied to the amorphous silicon to be crystallized. Moreover, if the driving transistor DR_TR is fabricated through the metal-induced crystallization, the driving transistor DR_TR may further include any one selected from the group consisting of nickel Ni, cadmium Cd, cobalt Co, titanium Ti, palladium Pd, tungsten W, aluminum Al and an equivalent thereof.

An anode of the organic light emitting diode OLED may be coupled to a first electrode of a switching transistor SW_TR6 for applying a reverse bias and a second electrode of the third switching transistor SW_TR3 and a cathode thereof may be coupled to the second power source line VSS. Such an organic light emitting diode OLED emits light at a predetermined brightness by current controlled through the driving transistor DR_TR while the third switching transistor SW_TR3 is being turned on.

Subsequently, the organic light emitting diode OLED includes an emitting layer, not depicted, and the emitting layer may be any one selected from the group consisting of a fluorescent material, a phosphorescent material, a mixture thereof and an equivalent thereof; however, the material or the kind thereof are not limited thereto. Moreover, the emitting layer may be any one selected from the group consisting of a red light emitting material, a green light emitting material, a blue light emitting material, a mixture thereof and an equivalent thereof; however, the material or the kind thereof are not limited thereto.

A first electrode of the second switching material SW_TR2 may be coupled to the first power source line VDD and a second electrode B of the storage capacitor C, a second electrode thereof may be coupled to the second electrode of the first switching transistor SW_TR1 and a first electrode of the driving transistor DR_TR, and a control electrode thereof may be coupled to the emission control signal line EM[N].

Such a second switching transistor SW_TR2 may be a P-channel transistor and is turned on, if a signal of low level is applied to the control electrode thereof through the emission control signal line EM[N], to make the current from the first power source line VDD to flow in the organic light emitting diode OLED.

A first electrode A of the storage capacitor C may be connected to the control electrode of the driving transistor DR_TR, the second electrode of the fourth switching transistor SW_TR4 and a first electrode of the initial switching transistor SW_TR5, a second electrode thereof may be coupled to a first electrode of the second switching transistor SW_TR2 and the first power source line VDD.

Such a storage capacitor C maintains the data signal voltage and the threshold voltage Vth of the driving transistor at the first electrode thereof for a predetermined time and, if the second switching transistor SW_TR2 and the third switching transistor SW_TR3 are turned on as a signal of low level is applied thereto by the emission control signal line EM[N], makes the current in proportion to the magnitude of the data signal to flow from the first power source line VDD to the organic light emitting diode OLED so that the organic light emitting diode OLED emits light.

A first electrode of the fourth switching transistor SW_TR4 may be coupled to a second electrode of the driving transistor DR_TR, a second electrode thereof may be coupled to the control electrode of the driving transistor DR_TR and the first electrode A of the storage capacitor C, and a control electrode thereof may be coupled to the scan signal line S[N]. Such a fourth switching transistor SW_TR4 may be a P-channel transistor and is turned on, if a signal of low level is applied from the scan signal line S[N], to electrically connect the control electrode (gate electrode) with second electrode (drain electrode) of the driving transistor DR_TR, to be diode-like connected thereto as a result.

A first electrode of the initial switching transistor SW_TR5 may be coupled between the initial power source line Vinit and a second electrode of the switching transistor SW_TR6 for applying a reverse bias, a second electrode thereof may be coupled to the first electrode A of the storage capacitor C, a control electrode thereof may be coupled to the previous scan signal line S[N−1]. Such an initial switching transistor SW_TR5 may be a P-channel transistor and is turned on, if a signal of low level is applied from the previous scan signal line S[N−1], to electrically connect the initial power source line Vinit, the first electrode A of the storage capacitor C and the control electrode of the driving transistor DR_TR. Accordingly, the storage capacitor C and the control electrode of the driving transistor DR_TR are initialized.

A first electrode of the third switching transistor SW_TR3 may be coupled to the second electrode of the driving transistor DR_TR, a second electrode thereof may be coupled to the anode of the organic light emitting diode OLED, and a control electrode may be coupled to the emission control signal line EM[N]. Such a third switching transistor SW_TR3 may be a P-channel transistor and is turned on, if a signal of low level is applied from the emission control signal line EM[N], to electrically connect the driving transistor DR_TR with the organic light emitting diode OLED so that the current is applied from the driving transistor DR_TR to the organic light emitting diode OLED.

A first electrode of the switching transistor SW_TR6 for applying a reverse bias may be coupled to the anode of the organic light emitting diode OLED, a second electrode thereof may be coupled to the initial power source line Vinit, and a control electrode thereof may be coupled to the light emitting reverse control line EMB[N]. Such a switching transistor SW_TR6 for applying a reverse bias may be a P-channel transistor and is turned on, if a signal of low level is applied from the emission reverse control signal line EMB [N], to apply a reverse bias voltage to the organic light emitting diode OLED in the direction from the second power source line VSS to the initial power source line Vinit. To apply such a reverse bias voltage, it is desirable that the voltage of the second power source line VSS be higher than that of the initial power source line Vinit. If using a ground voltage as the voltage of the second power source line VSS, i.e., the cathode voltage of the organic light emitting diode OLED, the voltage of the initial power source line Vinit may have a negative value desirably.

Here, the first switching transistor SW_TR1, the driving transistor DR_TR, the second switching transistor SW_TR2, the third switching transistor SW_TR3, the fourth switching transistor SW_TR4, the initial switching transistor SW_TR5 and the switching transistor SW_TR6 for applying a reverse bias may be any one of the P-channel transistor and an equivalent thereof; however, the kind of the transistor is not limited hereto.

Figure 6:
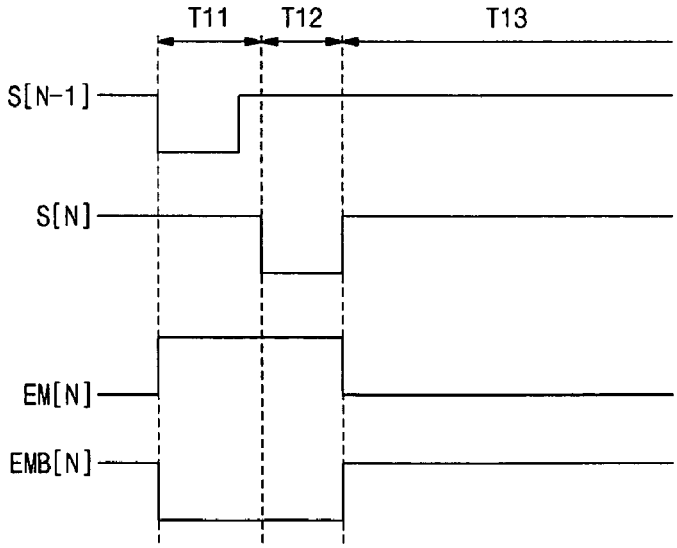
FIG. 6 is a driving timing diagram, in which the pixel circuit depicted in FIG. 5 is driven in a progressive scanning method.

Referring to FIG. 6, a driving timing diagram, in which the pixel circuit depicted in FIG. 5 is driven in the progressive scanning method, is depicted. As depicted in the figure, if the pixel circuit of the organic light emitting display in accordance with the present invention is driven in the progressive scanning method, a frame may be classified into a first period, a second period and a third period. More specifically, a frame may include an initialization period T11, a storage period T12 for storing a data voltage and a threshold voltage of the driving transistor and a light emission period T13. During the initialization period T11 and the storage period T12 for storing a data voltage and a threshold voltage of the driving transistor, a reverse bias voltage is applied to the organic light emitting diode OLED. The ratio of the initialization period T11, the storage period T12 for storing a data voltage and a threshold voltage of the driving transistor and the light emission period T13 may be made variously and, it is desirable that the times of the initialization period T11 and the storage period T12 for storing a data voltage and a threshold voltage of the driving transistor be set shorter that of the light emission period T13.

Figure 7:
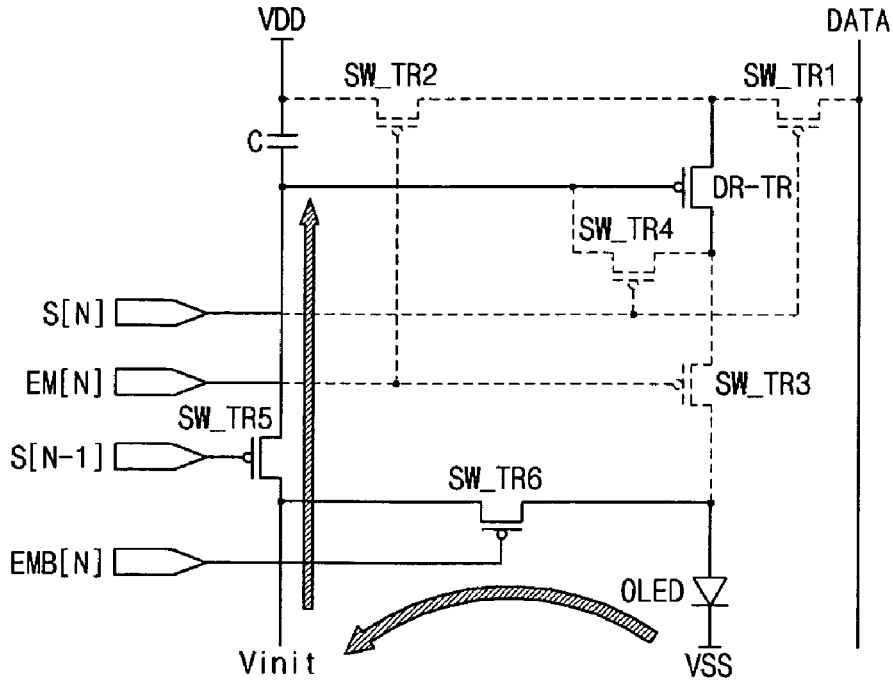
FIG. 7 depicts a current flow during an initialization period T11, in which the pixel circuit depicted in FIG. 5 is driven in a progressive scanning method.

Referring to FIG. 7, a current flow in the initialization period T11, in which the pixel circuit depicted in FIG. 5 is driven in the progressive scanning method, is depicted. Here, the operation of the pixel circuit will be described with reference to the timing diagram of FIG. 6.

First, the initial switching transistor SW_TR 5 is turned on as a scan signal of low level is applied from the previous scan signal line S[N−1] to the control electrode of the initial switching transistor SW_TR5, and the switching transistor SW_TR6 for applying a reverse bias is turned on as a signal of low level of The emission reverse control signal line EMB[N] is applied to the control electrode of the switching transistor SW_TR6 for applying a reverse bias. As the initial switching transistor SW_TR5 is turned on, the initial power voltage of the initial power source line Vinit is applied to a node, in which the first electrode A of the storage capacitor C is coupled to the control electrode of the driving transistor DR_TR, thus initializing the stored voltage of the storage capacitor C and the control electrode of the driving transistor DR_TR. Here, since the third switching transistor SW_TR3 is turned on as a signal of high level of the emission control signal line EM[N] is applied to the control electrode of the third switching transistor SW_TR3, the organic light emitting diode OLED does not emit light. If the voltage of the second power source line VSS is set higher than that of the initial power source line Vinit during such a non-light emission period, a reverse bias voltage is applied to the organic light emitting diode OLED, thus preventing degradation of the organic light emitting diode OLED. Moreover, a ground voltage may be used as the voltage of the second power source line VSS. In this case, a reverse bias voltage can be applied to the organic light emitting diode OLED if the voltage of the initial power source line Vinit applied thereto is a negative voltage. During such a period, the first switching transistor SW_TR1, the fourth switching transistor SW_TR4, the second switching transistor SW_TR2 and the third switching transistor SW_TR3 are turned off as a signal of high level is applied to the respective control electrodes. In other words, during the initialization period T11, the storage capacitor C and the control electrode of the driving transistor DR_TR are initialized and, simultaneously, a reverse bias voltage is applied thereto during the non-light emission period of the organic light emitting diode OLED.

Figure 8:
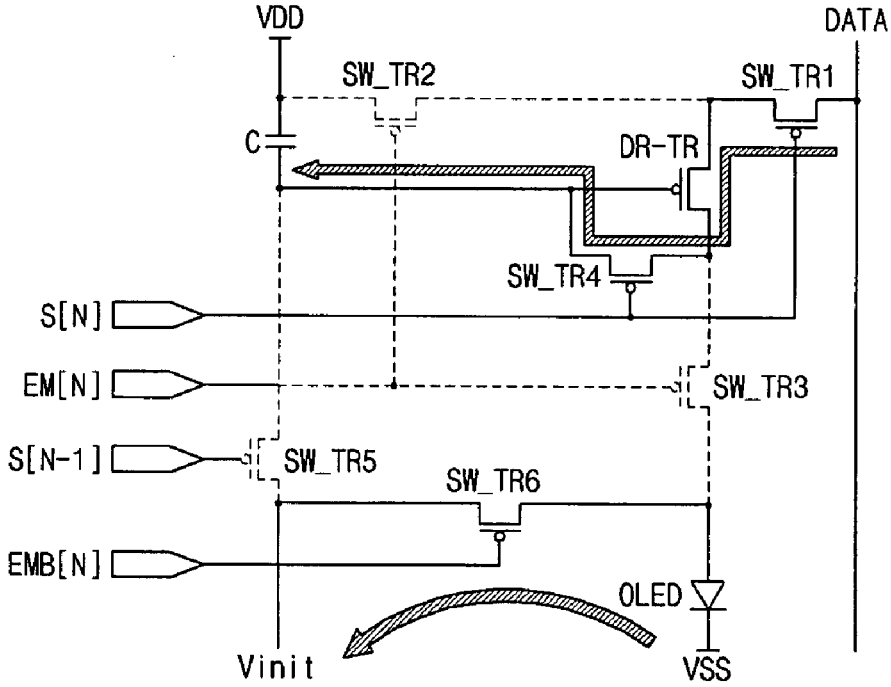
FIG. 8 depicts a current flow during a storage period T12 for storing a data voltage and a threshold voltage of a driving transistor, in which the pixel circuit depicted in FIG. 5 is driven in a progressive scanning method.

Referring to FIG. 8, a current flow during the storage period T12 for storing a data voltage and a threshold voltage of the driving transistor, in which the pixel circuit depicted in FIG. 5 is driven in the progressive scanning method, is depicted. Here, the operation of the pixel circuit will be described with reference to the timing diagram of FIG. 6.

First, the scan signal line S[N] is coupled to the control electrode of the first switching transistor SW_TR1. The first switching transistor SW_TR1 is turned on, if a scan signal of low level is applied from the scan signal line S[N], and then a data signal is applied from the data signal line D[M]. Moreover, the scan signal of low level of the scan signal line S[N] is applied to the control electrode of the fourth switching transistor SW_TR4 to be turned on. The fourth switching transistor SW_TR4 is coupled between the control electrode (gate electrode) and the second electrode (drain electrode) of the driving transistor DR_TR, thus making a diode-like connection.

The present invention including such a diode-like connection has a function of compensating the threshold voltage of the driving transistor. The principle of compensating the threshold voltage of the driving transistor will be described with reference to the following formula 1.

Figure 9:
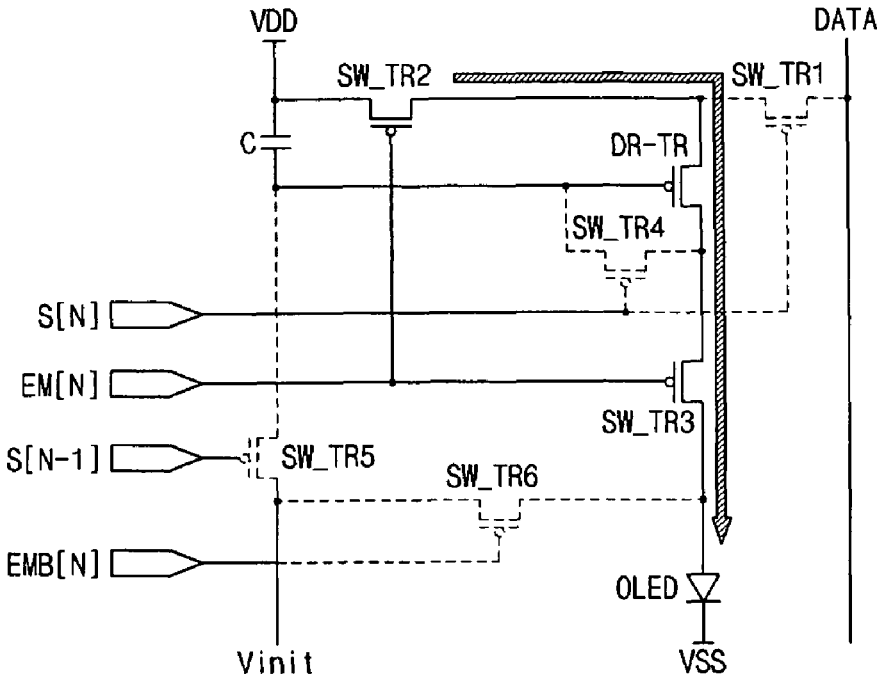
FIG. 9 depicts a current flow during a light emission period T13, in which the pixel circuit depicted in FIG. 5 is driven in a progressive scanning method.

Under the diode-like connection, the first power voltage VDD is applied to the second electrode B of the storage capacitor C and a voltage VDATA−|Vth| corresponding to a difference between the data voltage VDATA and the threshold voltage Vth of the driving transistor is applied to the first electrode A of the storage capacitor C. Referring to FIG. 9, a current flow during the light emission period T13, in which the pixel circuit depicted in FIG. 5 is driven in the progressive scanning method, is depicted, and the description will be given with reference to the timing diagram of FIG. 6.

Here, the current IOLED flowing in the organic light emitting diode OLED is the same as the following formula 1;

$$I_{OLED} = \frac{\beta}{2}(V_{GS} - V_{th})^2 = \frac{\beta}{2}(V_{SG} - |V_{th}|)^2 = \frac{\beta}{2}(V_{DD} - (V_{DATA} - |V_{th}|) - |V_{th}|)^2 \quad \text{[Formula 1]}$$

$$I_{OLED} = \frac{\beta}{2}(V_{DD} - V_{DATA})^2$$

wherein VDD denotes a first power voltage of the first power source line, VDATA denotes a data voltage applied through the data signal line, Vth denotes a threshold voltage of the driving transistor DR_TR, and β denotes a constant.

As can be seen from the above formula 1, the current IOLED flowing in the organic light emitting diode OLED during the light emission period T13 flows correspondingly to the data voltage VDATA regardless of the threshold voltage of the driving transistor DR_TR. That is, the threshold voltage Vth of the driving transistor DR_TR is compensated.

Moreover, as the emission reverse control signal line EMB[N] is coupled to the control electrode of the switching transistor SW_TR6 for applying a reverse bias, the switching transistor SW_TR6 for applying a reverse bias is being kept in a turned-on state by a signal of low level of the emission reverse control signal line EMB[N]. During such a period T12, since the third switching transistor SW_TR3 is being in a turned-off state as a signal of high level of the emission control signal line EM[N] is applied to the control electrode of the third switching transistor SW_TR3, like the initialization period T11, the organic light emitting diode OLED does not emit light. If the voltage of the second power source line VSS is set higher than that of the initial power source line Vinit during such a non-light emission period, a reverse bias voltage is applied to the organic light emitting diode OLED, thus preventing degradation of the organic light emitting diode OLED. Furthermore, a ground voltage may be used as the voltage of the second power source line VSS. In this case, a reverse bias voltage can be applied to the organic light emitting diode OLED if the voltage of the initial power source line Vinit applied thereto is a negative voltage. During such a period, the initial switching transistor SW_TR5, the second switching transistor SW_TR2 and the third switching transistor SW_TR3 are turned off as a signal of high level is applied to the respective control electrodes. In other words, during the storage period T12 for storing a data voltage and a threshold voltage of the driving transistor, the data voltage is stored in the storage capacitor C and, simultaneously, a reverse bias voltage is applied thereto during the non-light emitting period of the organic light emitting diode OLED.

Referring to FIG. 9, a current flow during the light emission period T13, in which the pixel circuit depicted in FIG. 5 is driven in the progressive scanning method, is depicted, and the description will be given with reference to the timing diagram of FIG. 6. First, if an emission control signal of low level is applied to the control electrode of the second switching transistor SW_TR2 coupled to the emission control signal line EM[N], the second switching transistor SW_TR2 is turned on, and the first power voltage is supplied from the first power source line VDD to the driving transistor DR_TR. Moreover, if an emission control signal of low level is applied to the control electrode of the third switching transistor SW_TR3 coupled to the emission control signal line EM[N], the third switching transistor SW_TR3 is turned on, and a driving voltage is supplied to the organic light emitting diode OLED through the driving transistor DR_TR. Accordingly, the organic light emitting diode emits light correspondingly to the respective data signals.

During this period, the first switching transistor SW_TR1, the fourth switching transistor SW_TR4, the initial switching transistor SW_TR5 and the switching transistor SW_TR6 for applying a reverse bias are turned off as a signal of high level is applied to the respective control electrodes.

In other words, during the light emission period T13, the data voltage stored in the storage capacitor C and the threshold voltage of the driving transistor are applied through the driving transistor DR_TR so that the organic light emitting diode OLED emits light. At this time, the switching transistor SW_TR6 for applying a reverse bias is turned on and thereby it does not perform an operation of applying a reverse bias voltage to the organic light emitting diode OLED. It is desirable that the initialization period T11 and the storage period T12 for storing a data voltage and a threshold voltage of the driving transistor be set shorter than the light emission period T13 so as to prolong the time that the organic light emitting diode OLED emits light.

Figure 10:
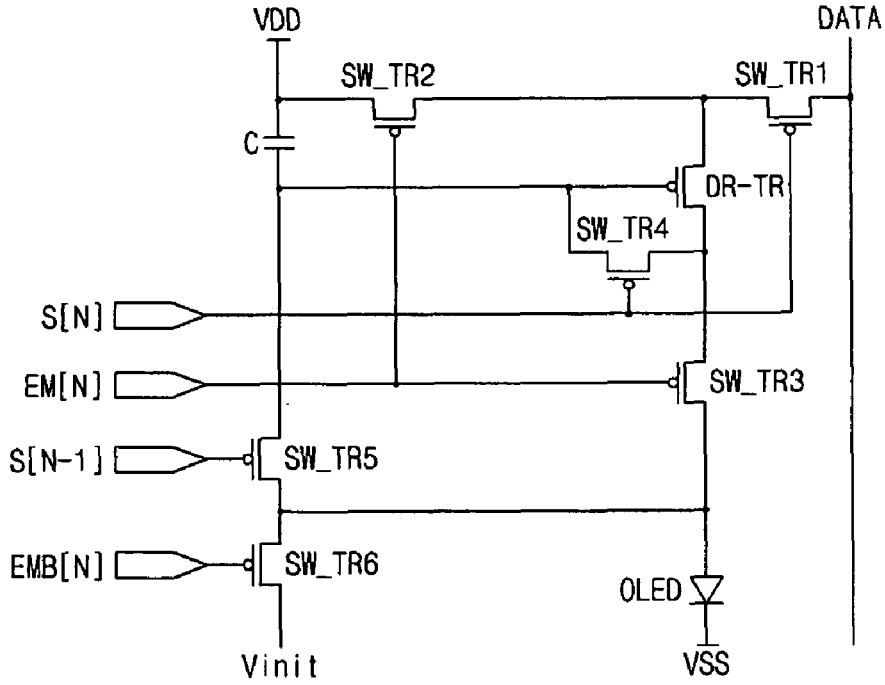
FIG. 10 is a circuit diagram depicting a pixel circuit of an organic light emitting display in accordance with another embodiment of the present invention.

Referring to FIG. 10, a pixel circuit of an organic light emitting display in accordance with another embodiment of the present invention is depicted. The pixel circuit depicted in FIG. 10 is identical with that of FIG. 5. However, the first electrode of the switching transistor SW_TR6 for applying a reverse bias in the pixel circuit depicted in FIG. 10 is coupled to the first electrode of the initial switching transistor SW_TR5. That is, the configuration in which the switching transistor SW_TR6 for applying a reverse bias is positioned between the second power source line VSS and the initial power source line Vinit is identical with that of FIG. 5; however, in another embodiment of FIG. 10, the first electrode of the switching transistor SW_TR6 for applying a reverse bias may be coupled to the first electrode of the initial switching transistor SW_TR5, differently from the configuration of FIG. 5, in which the first electrode of the switching transistor SW_TR5 is coupled to a common node between the anode of the organic light emitting diode OLED and the third switching transistor SW_TR3.

Figure 11:
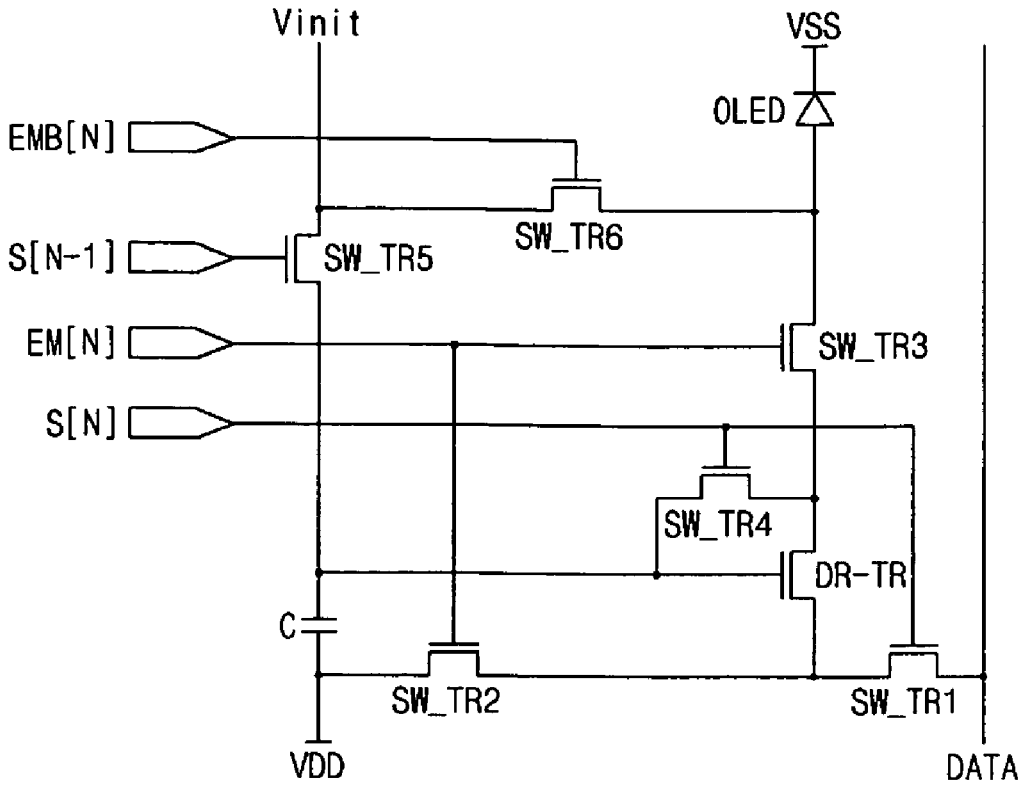
FIG. 11 is a circuit diagram depicting a pixel circuit of an organic light emitting display in accordance with still another embodiment of the present invention.

Referring to FIG. 11, a pixel circuit of an organic light emitting display in accordance with still another embodiment of the present invention is depicted. The pixel circuit depicted in FIG. 11 is also identical with that of FIG. 5. However, all transistors depicted in FIG. 11 are N-channel transistors, while all those transistors in the pixel circuit depicted in FIG. 5 are P-channel transistors. Accordingly, the electrical connections between the respective elements are slightly different from those depicted in FIG. 5.

For example, if the top and bottom of the pixel circuit using P-channel transistors of FIG. 5 are turned over, if the direction of the organic light emitting diode OLED is left the same as FIG. 5, and if the P-channel transistors are replaced with the N-channel transistors, the pixel circuit using N-channel transistors of FIG. 11 can be achieved. Here, the positions of the first electrodes (source electrodes or drain electrodes) and the second electrodes (drain electrodes or source electrodes) of the P-channel transistor and the N-channel transistor are changed reversely.

Figure 12:
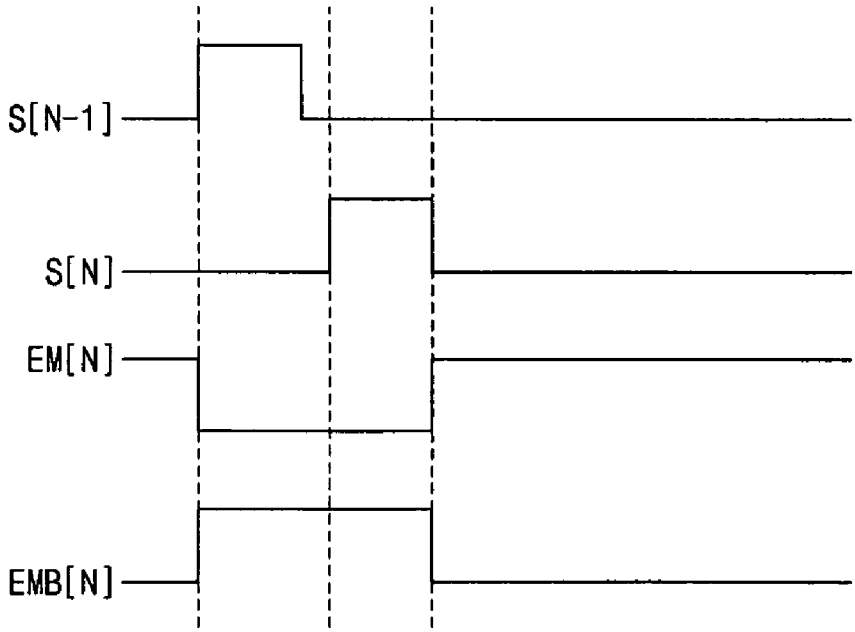
FIG. 12 is a driving timing diagram, in which the pixel circuit depicted in FIG. 11 is driven in a progressive scanning method.

FIG. 12 is a driving timing diagram, in which the pixel circuit using the N-channel transistors depicted in FIG. 11 is driven in a progressive scanning method. The N-channel transistor is turned on if a signal of high level is applied to the control electrode thereof. When comparing the driving timing diagram depicted in FIG. 12 with that of FIG. 6, a signal of high level is changed into a signal of low level and a signal of low level is changed into a signal of high level.

Figure 13:
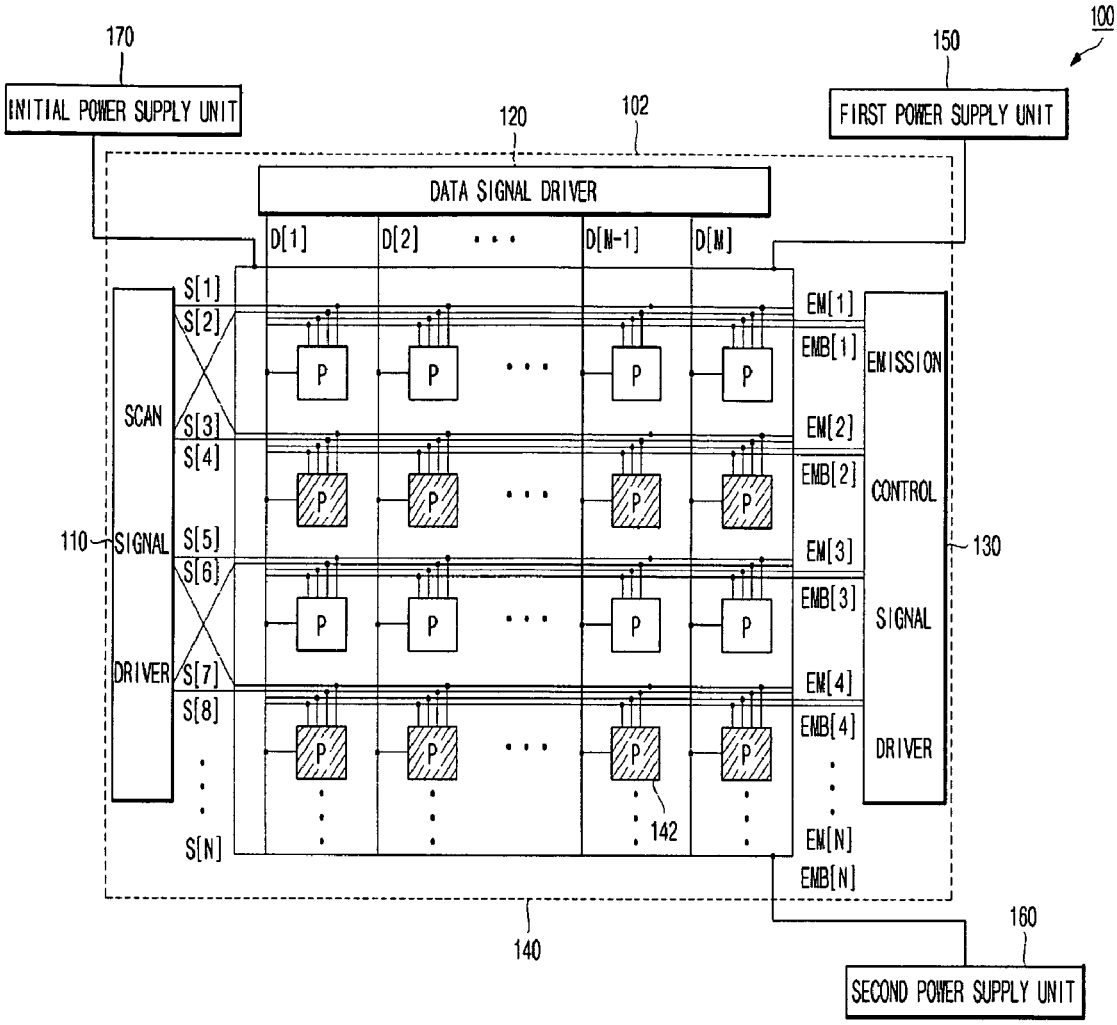
FIG. 13 is a block diagram depicting a basic structure of an organic light emitting display in accordance with the present invention driven in an interlaced scanning method.

Referring to FIG. 13, a block diagram depicting a basic structure of an organic light emitting display in accordance with the present invention driven in an interlaced scanning method is shown.

As depicted in FIG. 13, an organic light emitting display 100 may include a scan signal driver 110, a data signal driver 120, a emission control signal driver 130, an organic light emitting display panel 140 (hereinafter referred to as the panel 140), a first power supply unit 150, a second power supply unit 160, and an initial power supply unit 170.

The scan signal driver 110 may supply scan signals to the panel 140 through a plurality of scan signal lines S[1] to S[N]. As depicted in FIG. 13, the scan signal lines may be configured in such a manner that a first scan signal line and a third scan signal line are coupled to pixels in a first line, and a second scan signal line and a fourth scan signal line are coupled to pixels in a second line. That is, the scan signal lines may be coupled to pixels on odd and even lines in sequence.

The data signal driver 120 may supply data signals to the panel 140 through a plurality of data signal lines D[1] to D[M].

The emission control signal driver 130 may supply in sequence emission control signals and emission reverse control signals to the panel 140 through a plurality of emission control signal lines EM[1] to EM[N] and a plurality of emission reverse control signal lines EMB[1] to EMB[N].

Moreover, the panel 140 may include a plurality of scan signal lines S[1] to S[N], a plurality of emission control signal lines EM[1] to EM[N] and a plurality of emission reverse control signals EMB[1] to EMB[N], arranged in the vertical direction, a plurality of data signal lines D[1] to D[M] arranged in the horizontal direction, and a plurality of pixel circuits 142 defined by the scan signal lines S[1] to S[N], the emission control signal lines EM[1] to EM[N], the emission reverse control signal lines EMB[1] to EMB[N] and the data signal lines D[1] to D[M].

Here, the pixel circuit 142 may be formed in a pixel area defined by the scan line and the data line. As described above in detail, the scan signals may be supplied from the scan signal driver 110 to the scan signal lines S[1] to S[N], the data voltages may be supplied from the data signal driver 120 to the data signal lines D[1] to D[M], and the emission control signals and the emission reverse control signals may be supplied from the emission control signal driver 130 to the emission control signal lines EM[1] to EM[N] and the emission reverse control signal lines EMB[1] to EMB[N]. Moreover, the first power supply unit 150, the second power supply unit 160 and the initial power supply unit 170 supply a first power voltage, a second power voltage and an initial power voltage to the pixel circuits 142, respectively.

As depicted in FIG. 13, the scan signal driver 110, the data signal driver 120, the emission control signal driver 130, the panel 140, the first power supply unit 150, the second power supply unit 160 and the initial power supply unit 170 may be arranged all on a single substrate 102.

Especially, the drivers 110, 120 and 130 and the power supply units 150, 160 and 170 may be established on the same layer where the scan signal lines S[1] to S[N], the data signal lines D[1] to D[M], the emission control signal lines EM[1] to EM[N], the emission reverse control signal lines EMB[1] to EMB[N] and the pixel circuits 142 are established.

It is possible to form the drivers 110, 120 and 130 and the power supply units 150, 160 and 170 on a separate substrate, not depicted, different from the substrate 102, and electrically connect the substrate with the substrate 102. Furthermore, the drivers 110, 120 and 130 and the power supply units 150, 160 and 170 may be arranged in a form selected from the group consisting of a tape carrier package TCP, a flexible printed circuit FPC, a tape automatic bonding TAB, a chip on glass COG and an equivalent thereof coupled to the substrate 102; however, the form and the position of the drivers 110, 120 and 130 and the power supply units 150, 160 and 170 are not limited thereto in the present invention.

Figure 14:
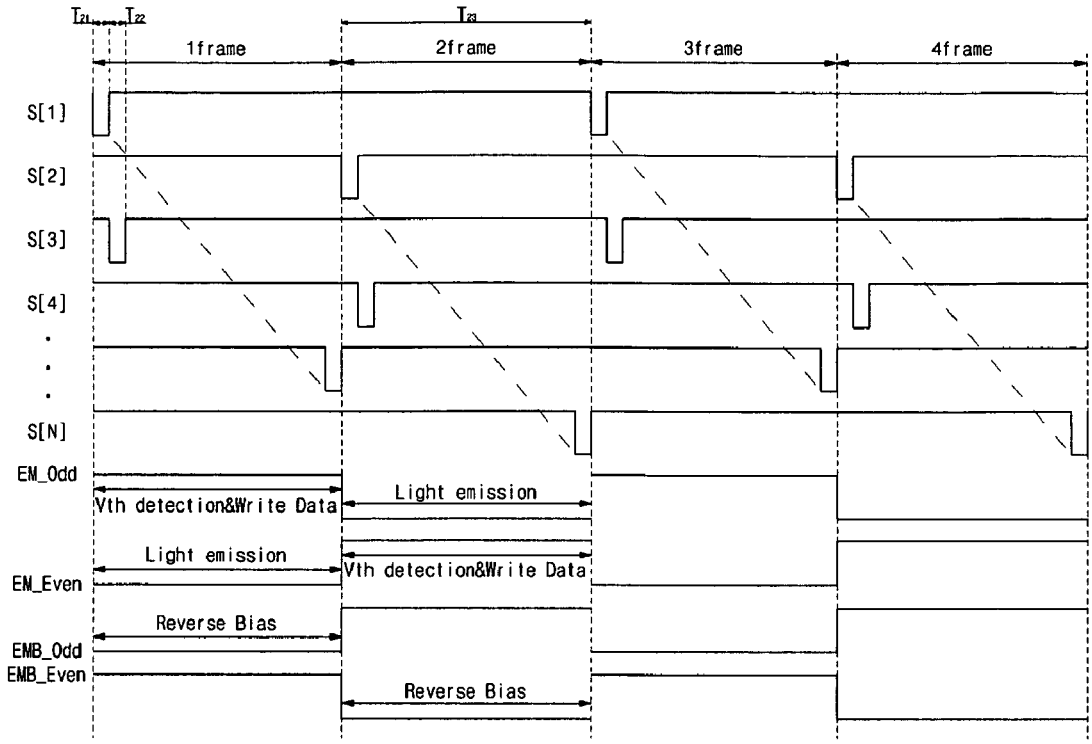
FIG. 14 is a driving timing diagram, in which the pixel circuit depicted in FIG. 5 is driven in an interlaced scanning method.

Referring to FIG. 14, a driving timing diagram, in which the pixel circuit depicted in FIG. 5 is driven in the interlaced scanning method, is depicted. As depicted in FIG. 14, the pixel circuit of the organic light emitting display in accordance with the present invention proceeds with a first frame, a second frame, a third frame and a fourth frame in sequence, in which the driving timing diagram of the odd frames such as the first frame, the third frame and the fifth frame may be the same and the driving timing diagram of the even frames such as the second frame, the fourth frame and the six frame may be the same.

In more detail, during the odd frame period, each of the pixels on the odd line writes a data voltage and a threshold voltage of the driving transistor to the storage capacitor C in the pixel circuit and, simultaneously, applies a reverse bias voltage to the organic light emitting diode OLED. During such an odd frame period, the pixels on the even line emit light.

Meanwhile, during the even frame period, each of the pixels on the odd line emits light and each of the pixels on the even line writes a data voltage and a threshold voltage of the driving transistor to the storage capacitor C in the pixel circuit and, simultaneously, applies a reverse bias voltage to the organic light emitting diode OLED.

Like this, while the pixels on the odd line in the panel emit light as the odd frame and the even frame are performed in sequence, each of the pixels on the even line performs the data write and applies a reverse bias voltage to the organic light emitting diode OLED. While the pixels on the even line in the panel emit light as the odd frame and the even frame are performed in sequence, each of the pixels on the odd line performs the data write and applies a reverse bias voltage to the organic light emitting diode OLED. That is, by driving the pixel circuits in such an interlaced scanning method, it is possible to ensure an operation margin of a driving circuit when driving a large-size panel.

Figure 15:
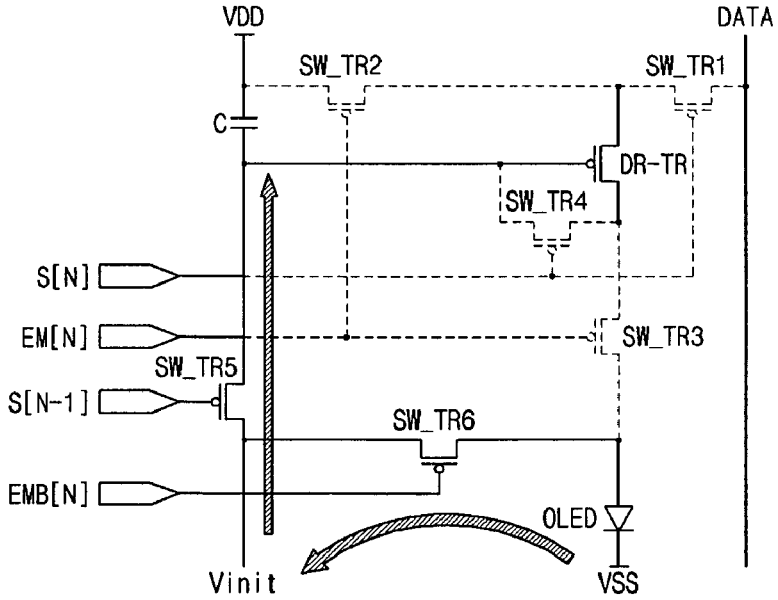
FIG. 15 depicts a current flow during an initialization period T21 in a pixel circuit on an odd line, in which the pixel circuit depicted in FIG. 5 is driven in an interlaced scanning method.

Referring to FIG. 15, a current flow during the initialization period T21 in a pixel circuit on an odd line, in which the pixel circuit depicted in FIG. 5 is driven in the interlaced scanning method, is shown. Here, the operation of the pixel circuit will be described with reference to the driving timing diagram of FIG. 14.

First, the initial switching transistor SW_TR5 is turned on as a scan signal of low level is applied from the previous scan signal line S[N−1] to the control electrode of the initial switching transistor SW_TR5, and the switching transistor SW_TR6 for applying a reverse bias is turned on as a signal of low level of The emission reverse control signal line EMB[N] is applied to the control electrode of the switching transistor SW_TR6 for applying a reverse bias.

As the initial switching transistor SW_TR5 is turned on, an initial power voltage of the initial power source line Vinit is applied to a node, in which the first electrode A of the storage capacitor C is coupled to the control electrode of the driving transistor DR_TR, thus initializing the stored voltage of the storage capacitor C and the control electrode of the driving transistor DR_TR. Here, since the third switching transistor SW_TR3 is turned on as a signal of high level of the emission control signal line EM[N] is applied to the control electrode of the third switching transistor SW_TR3, the organic light emitting diode OLED does not emit light. If the voltage of the second power source line VSS is set higher than that of the initial power source line Vinit during such a non-light emission period, a reverse bias voltage is applied to the organic light emitting diode OLED, thus preventing degradation of the organic light emitting diode OLED. Moreover, a ground voltage may be used as the voltage of the second power source line VSS. In this case, a reverse bias voltage can be applied to the organic light emitting diode OLED if the voltage of the initial power source line Vinit applied thereto is a negative voltage.

During such a period, the first switching transistor SW_TR1, the fourth switching transistor SW_TR4, the second switching transistor SW_TR2 and the third switching transistor SW_TR3 are turned off as a signal of high level is applied to the respective control electrodes.

In other words, during the initialization period T21 of the pixel circuit on the odd line, the storage capacitor C and the control electrode of the driving transistor DR_TR are initialized and, simultaneously, a reverse bias voltage is applied thereto during the non-light emission period of the organic light emitting diode OLED.

Figure 16:
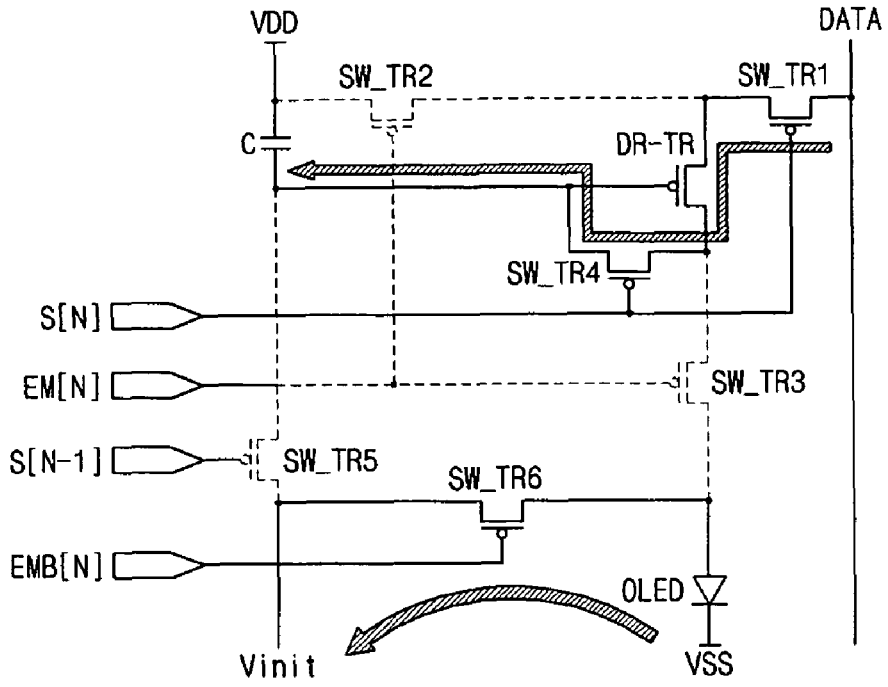
FIG. 16 depicts a current flow during a storage period T22 of a data voltage and a threshold voltage of a driving transistor in a pixel circuit on an odd line, in which the pixel circuit depicted in FIG. 5 is driven in an interlaced scanning method.

Referring to FIG. 16, a current flow during the storage period T22 of a data voltage and a threshold voltage of the driving transistor in a pixel circuit on an odd line, in which the pixel circuit depicted in FIG. 5 is driven in the interlaced scanning method, is depicted. Here, the operation of the pixel circuit will be described with reference to the driving timing diagram of FIG. 14.

First, the scan signal line S[N] is coupled to the control electrode of the first switching transistor SW_TR1. The first switching transistor SW_TR1 is turned on, if a scan signal of low level is applied from the scan signal line S[N], and then a data signal is applied from the data signal line D[M]. Moreover, the scan signal of low level of the scan signal line S[N] is applied to the control electrode of the fourth switching transistor SW_TR4 to be turned on. The fourth switching transistor SW_TR4 is coupled between the control electrode (gate electrode) and the second electrode (drain electrode) of the driving transistor DR_TR, thus making a diode-like connection. The present invention including such a diode-like connection has a function of compensating the threshold voltage of the driving transistor. The principle of compensating the threshold voltage of the driving transistor will be described with reference to the following formula 1.

Under the diode-like connection, the first power voltage VDD is applied to the second electrode B of the storage capacitor C and a voltage VDATA−|Vth| corresponding to a difference between the data voltage VDATA and the threshold voltage Vth of the driving transistor is applied to the first electrode A of the storage capacitor C.

Figure 17:
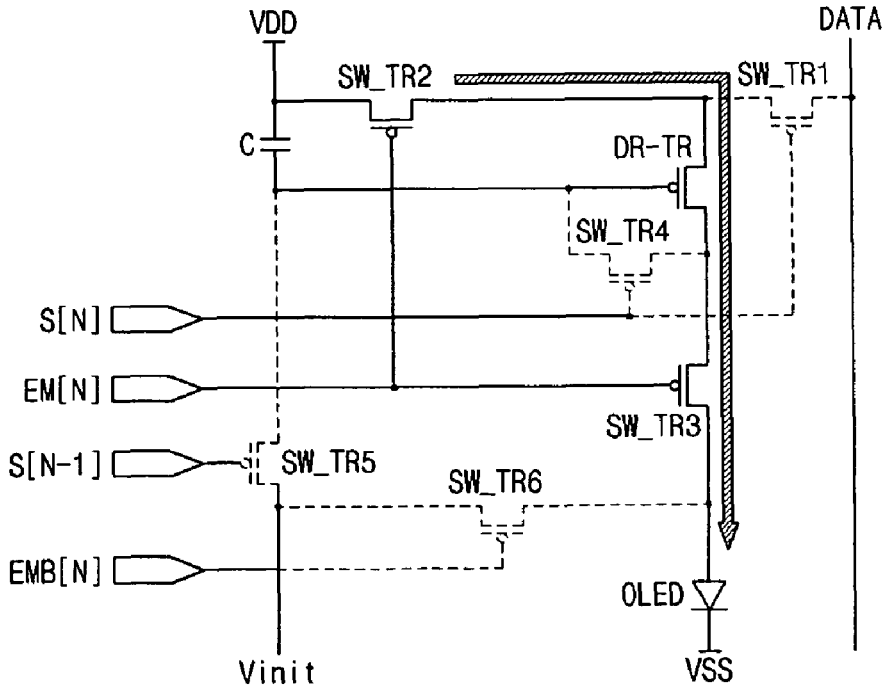
FIG. 17 depicts a current flow during a light emission period T23 in a pixel circuit on an odd line, in which the pixel circuit depicted in FIG. 5 is driven in an interlaced scanning method.

Referring to FIG. 17, a current flow during the light emission period T23 in a pixel circuit on an odd line, in which the pixel circuit depicted in FIG. 5 is driven in the interlaced scanning method, is depicted, and the description will be given with reference to the timing diagram of FIG. 14.

Here, the current IOLED flowing in the organic light emitting diode OLED is the same as the following formula 1:

$$I_{OLED} = \frac{\beta}{2}(V_{GS} - V_{th})^2 = \frac{\beta}{2}(V_{SG} - |V_{th}|)^2 = \frac{\beta}{2}(V_{DD} - (V_{DATA} - |V_{th}|) - |V_{th}|)^2$$

$$I_{OLED} = \frac{\beta}{2}(V_{DD} - V_{DATA})^2 \quad \text{[Formula 1]}$$

wherein VDD denotes a first power voltage of the first power source line, VDATA denotes a data voltage applied through the data signal line, Vth denotes a threshold voltage of the driving transistor DR_TR, and β denotes a constant.

As can be seen from the above formula 1, the current IOLED flowing in the organic light emitting diode OLED during the light emission period T23 flows correspondingly to the data voltage VDATA regardless of the threshold voltage of the driving transistor DR_TR. That is, the threshold voltage Vth of the driving transistor DR_TR is compensated.

Moreover, as The emission reverse control signal line EMB[N] is coupled to the control electrode of the switching transistor SW_TR6 for applying a reverse bias, the switching transistor SW_TR6 for applying a reverse bias is being kept in a turned-on state by a signal of low level of The emission reverse control signal line EMB[N].

During such a period T22, since the third switching transistor SW_TR3 is being in a turned-off state as a signal of high level of the emission control signal line EM[N] is applied to the control electrode of the third switching transistor SW_TR3, like the initialization period T21, the organic light emitting diode OLED does not emit light. If the voltage of the second power source line VSS is set higher than that of the initial power source line Vinit during such a non-light emission period, a reverse bias voltage is applied to the organic light emitting diode OLED, thus preventing degradation of the organic light emitting diode OLED. Furthermore, a ground voltage may be used as the voltage of the second power source line VSS. In this case, a reverse bias voltage can be applied to the organic light emitting diode OLED if the voltage of the initial power source line Vinit applied thereto is a negative voltage.

During such a period, the initial switching transistor SW_TR5, the second switching transistor SW_TR2 and the third switching transistor SW_TR3 are turned off as a signal of high level is applied to the respective control electrodes.

In other words, during the storage period T22 for storing a data voltage and a threshold voltage of the driving transistor, the data voltage is stored in the storage capacitor C and, simultaneously, a reverse bias voltage is applied thereto during the non-light emission period of the organic light emitting diode OLED.

Referring to FIG. 17, a current flow during the light emission period T23 in a pixel circuit on an odd line, in which the pixel circuit depicted in FIG. 5 is driven in the interlaced scanning method, is depicted, and the description will be given with reference to the timing diagram of FIG. 14. First, if an emission control signal of low level is applied to the control electrode of the second switching transistor SW_TR2 coupled to the emission control signal line EM[N], the second switching transistor SW_TR2 is turned on, and the first power voltage is supplied from the first power source line VDD to the driving transistor DR_TR.

Moreover, if an emission control signal of low level is applied to the control electrode of the third switching transistor SW_TR3 coupled to the emission control signal line EM[N], the third switching transistor SW_TR3 is turned on, and a driving voltage is supplied to the organic light emitting diode OLED through the driving transistor DR_TR. Accordingly, the organic light emitting diode emits light correspondingly to the respective data signals.

During this period, the first switching transistor SW_TR1, the fourth switching transistor SW_TR4, the initial switching transistor SW_TR5 and the switching transistor SW_TR6 for applying a reverse bias are turned off as a signal of high level is applied to the respective control electrodes.

In other words, during the light emission period T23, the data voltage stored in the storage capacitor C and the threshold voltage of the driving transistor are applied through the driving transistor DR_TR so that the organic light emitting diode OLED emits light. At this time, the switching transistor SW_TR6 for applying a reverse bias is turned off and thereby it does not perform an operation of applying a reverse bias voltage to the organic light emitting diode OLED.

Figure 18:
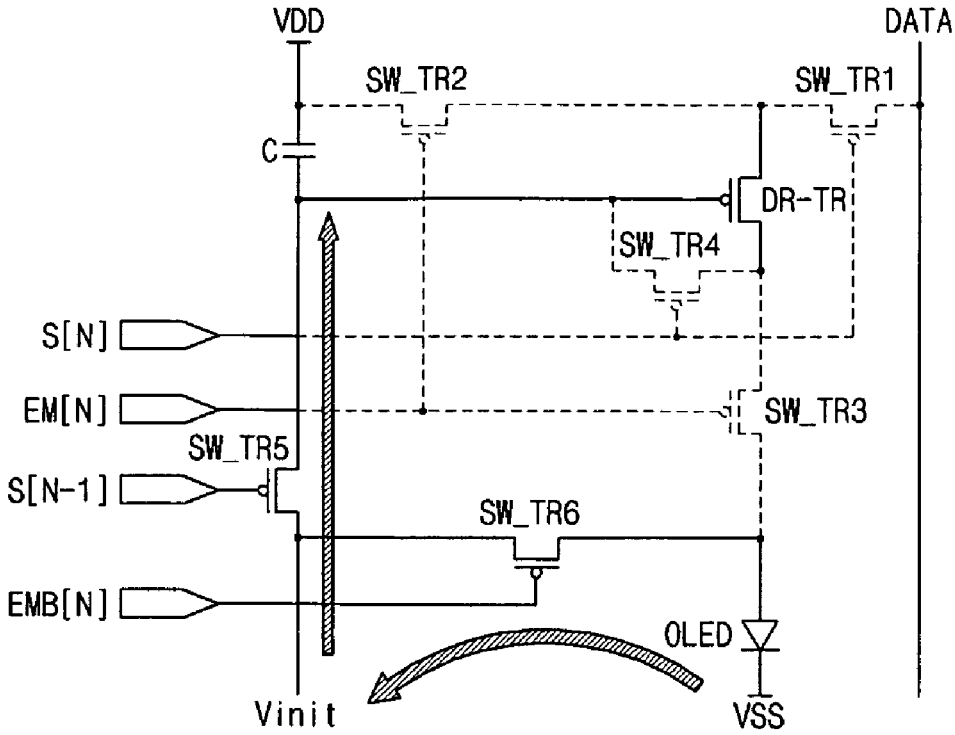
FIG. 18 depicts a current flow during an initialization period in a pixel circuit on an even line, in which the pixel circuit depicted in FIG. 5 is driven in an interlaced scanning method.
Figure 19:
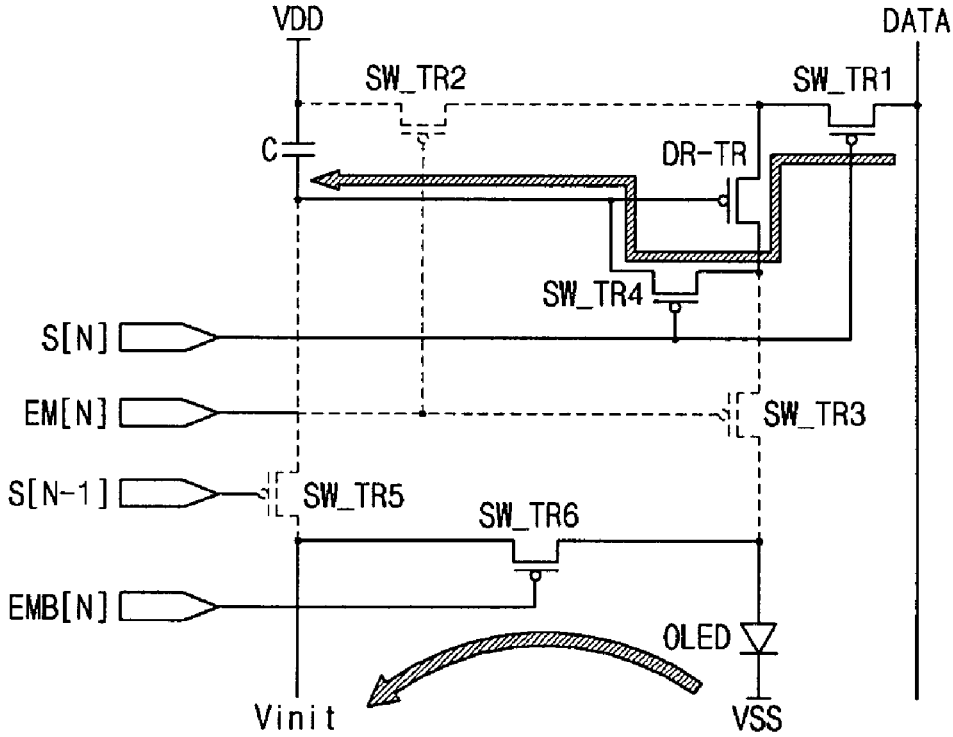
FIG. 19 depicts a current flow during a storage period of a data voltage and a threshold voltage of a driving transistor in a pixel circuit on an even line, in which the pixel circuit depicted in FIG. 5 is driven in an interlaced scanning method.
Figure 20:
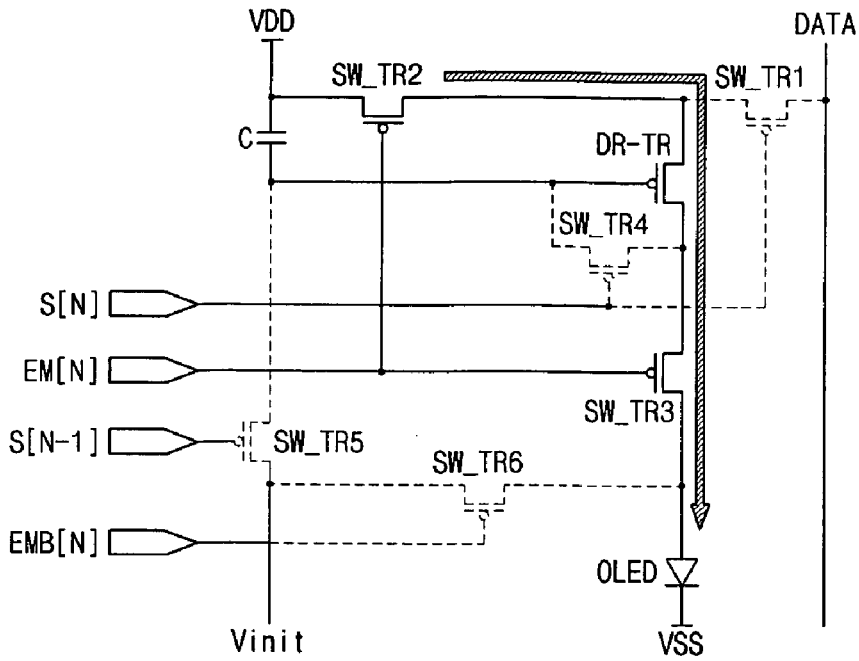
FIG. 20 depicts a current flow during a light emission period in a pixel circuit on an even line, in which the pixel circuit depicted in FIG. 5 is driven in an interlaced scanning method.

Referring to FIG. 18, a current flow during the initialization period in a pixel circuit on an even line, in which the pixel circuit depicted in FIG. 5 is driven in the interlaced scanning method, is depicted. Referring to FIG. 19, a current flow during the storage period of a data voltage and a threshold voltage of the driving transistor in a pixel circuit on an even line, in which the pixel circuit depicted in FIG. 5 is driven in the interlaced scanning method, is shown. Referring to FIG. 20, a current flow during the light emission period in a pixel circuit on an even line, in which the pixel circuit depicted in FIG. 5 is driven in the interlaced scanning method, is drawn. Here, the operation of the pixel circuit will be described with reference to the driving timing diagram of FIG. 14.

During the first frame period, the pixel circuits on the odd line proceed with the initialization period T21 and the storage period T22 of a data voltage and a threshold voltage of the driving transistor in sequence, and the pixel circuits on the even line perform the light emission operation of the organic light emitting diodes OLEDs as can be seen from the current flow depicted in FIG. 20. During the second frame period, the pixel circuits on the even line execute the initialization period and the storage period of a data voltage and a threshold voltage of the driving transistor in sequence, and the pixel circuits on the odd line emit light.

Figure 21:
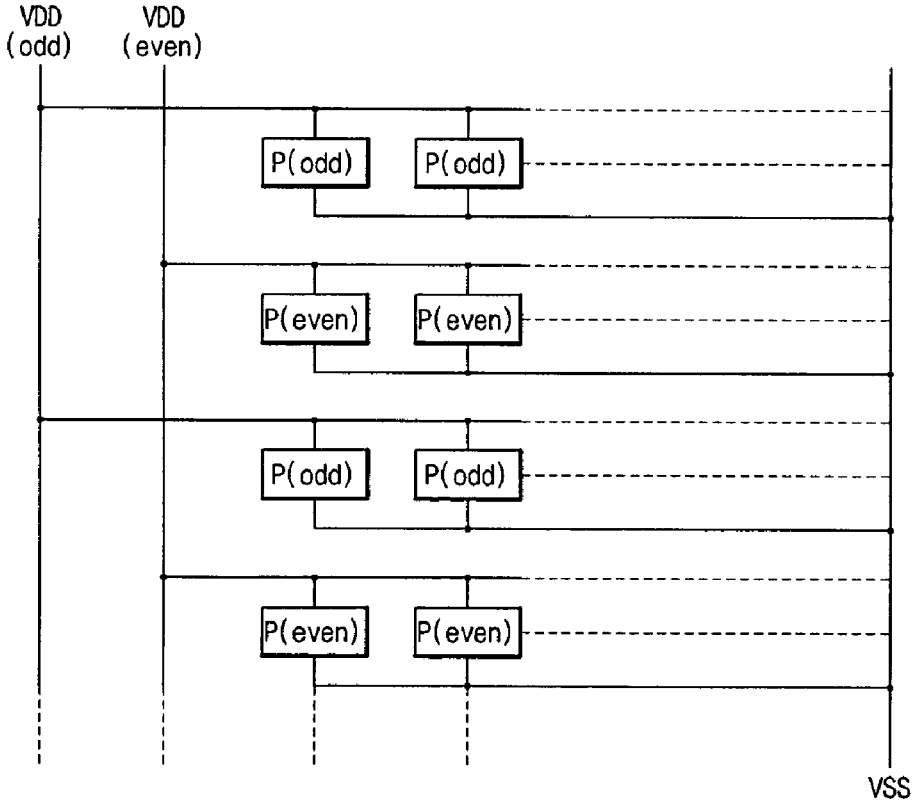
FIG. 21 depicts an electrical connection between a first power source line including an odd line and an even line and the respective pixels of the organic light emitting display depicted in FIG. 13.

The current flow diagrams of the pixel circuits on the even line depicted in FIGS. 18, 19 and 20 are the same as the pixel circuits on the odd line shown in FIGS. 15, 16 and 17; however, those have differences in that the pixel circuits on the odd line execute the initial and data write operations during the odd frame period, whereas, the pixel circuits on the even line perform the initial and data write operations during the even frame period Referring to FIG. 21, an electrical connection between the first power source line including (odd line and even line) and the respective pixels of the organic light emitting display depicted in FIG. 13 is shown. The first power source line may include two lines of an odd first power source line VDD/Odd and an even first power source line VDD/Even; however, the second power source line VSS is composed of one line.

If driving the first power source line VDD with such two lines, and if dividing the data write period from the light emission period in driving the panel by applying an interlaced scanning method, it is possible to prevent a voltage drop (IR-drop) of the first power source line VDD, which will be described in more detail with reference to the driving timing diagram depicted in FIG. 14 below.

During the first frame period, the pixel circuit on the odd line initializes the storage capacitor C and the control electrode of the driving transistor, writes data in the storage capacitor C and applies a reverse bias voltage to the organic light emitting diode OLED. During such a first frame period, the third switching transistor SW_TR3 in the pixel circuit is turned off and thereby the electrical connection from the odd first power source line VDD/Odd to the second power source line VSS are cut off in the pixel circuits on the odd line. Accordingly, during the first frame period, the pixel circuits on the odd line perform the data write operation without any voltage drop (IR-drop), Such pixel circuits on the odd line emit light during the second frame period, in which the current flow of the pixel circuit on the odd line is the same as depicted in FIG. 17.

At this time, the current flowing in the organic light emitting diode is the same as formula 1:

$$I_{OLED} = \frac{\beta}{2}(V_{GS} - V_{th})^2 = \frac{\beta}{2}(V_{SG} - |V_{th}|)^2 = \frac{\beta}{2}(V_{DD} - (V_{DATA} - |V_{th}|) - |V_{th}|)^2 \quad \text{[Formula 1]}$$

$$I_{OLED} = \frac{\beta}{2}(V_{DD} - V_{DATA})^2$$

That is, when the data has been written in the storage capacitor C and then it becomes the light emission period, in the case where there is no voltage drop (IR-drop), the current IOLED flowing in the respective pixel circuit on the odd line has no voltage drop (IR-drop) as can bee seen from the above formula 1. Accordingly, the pixels on the odd line have no voltage drop (IR-drop) during the light emission period due to the VDD having no voltage drop (IR-drop), thus preventing the brightness of the pixels from being decreased.

Likewise, since the data are written in the pixels on the even line in the state where there is no voltage drop (IR-drop) during the second frame period, it is possible to drive the panel without any voltage drop (IR-drop) during the light emission period.

As described in detail above, if driving the organic light emitting display and the pixel circuits thereof in accordance with the present invention in the progressive scanning method, the image display period of one frame is classified into the first period, the second period and the third period. During the first period, the storage capacitor and the control electrode of the driving transistor are initialized and, simultaneously, a reverse bias voltage is applied to the organic light emitting diode, thus preventing degradation of the organic light emitting diode. Moreover, during the second period, the data voltage and the threshold voltage of the driving transistor are stored in the storage capacitor and, simultaneously, a reverse bias voltage is applied to the organic light emitting diode, thus preventing degradation of the organic light emitting diode. Furthermore, during the third period, the operation of applying a reverse bias voltage to the organic light emitting diode is stopped and, simultaneously, the current corresponding to the data voltage stored in the storage capacitor and the threshold voltage of the driving transistor are supplied to the organic light emitting diode through the driving transistor, thus making the organic light emitting diode to emit light.

The progressive scanning method is to prevent the degradation of the organic light emitting diode by applying a reverse bias voltage to the organic light emitting diode in the non-light emission period, thus improving the lifespan of the organic light emitting diode and the non-uniformity of the brightness of the respective pixels caused by the difference of the degradation degrees of the organic light emitting diodes in the respective pixel circuits.

Moreover, if driving the organic light emitting display and the pixel circuits thereof in accordance with the present invention in the interlaced scanning method, the image display period is classified into the first frame (odd frame) and the second frame (even frame). During the first frame, each of the pixels on the odd line in sequence stores the data voltage and the threshold voltage of the driving transistor in the storage capacitor and, simultaneously, applies a reverse bias voltage to the organic light emitting diode so that the pixels on the even line emit light.

During the second frame, each of the pixels on the odd line emits light and each of the pixels on the even line in sequence stores the data voltage and the threshold voltage of the driving transistor and, simultaneously, applies a reverse bias voltage to the organic light emitting diode. As the above frames are performed in sequence, the image display unit (panel) of the organic light emitting display is driven in the interlaced scanning method.

With the driving method using such an interlaced scanning method, it is possible to ensure an operation margin of a driving circuit when driving a large-size panel and prevent a voltage drop (IR-drop) of the first power source line by dividing the light emission period from the data write period.

Moreover, it is possible to prevent the degradation of the organic light emitting diode by applying a reverse bias voltage to the organic light emitting diode during the non-light emission period.

As above, exemplary embodiments of the present invention have been described and illustrated, however, the present invention is not limited thereto thereto, rather, it should be understood that various modifications and variations of the present invention can be made thereto by those skilled in the art without departing from the spirit and the technical scope of the present invention as defined by the appended claims.

What is claimed is:

1. An organic light emitting display comprising a scan signal line forwarding a scan signal, an emission control signal line forwarding an emission control signal, an emission reverse control signal line forwarding an emission reverse control signal, a data line sending a data signal, and a pixel coupled to the scan signal line, the emission control signal line, the emission reverse control signal line, and the data line, the organic light emitting diode display, wherein the pixel includes:

a first switching transistor transmitting a data signal from the data line in response to the scan signal of the scan signal line;

a driving transistor, coupled to the first switching transistor, controlling driving current from a first power source line;

a storage capacitor coupled between the driving transistor and the first power source line;

an organic light emitting diode, coupled between the driving transistor and a second power source line, displaying an image with the driving current controlled by the driving transistor;

an initial switching transistor, coupled between the storage capacitor and an initial power source line, initializing the storage capacitor; and a switching transistor, coupled between the second power source line and the initial power source line, a control electrode of the switching transistor is coupled to the emission reverse control signal line, the emission reverse control signal line is an inverted signal of the emission control signal line, and the switching transistor applies a reverse bias voltage to the organic light emitting diode, wherein the respective pixels are classified into an odd line and an even line in the horizontal direction and driving periods of the pixels on the odd and even lines are classified into a storage period for storing a data voltage and a threshold voltage of the driving transistor and a light emission period.

2. The organic light emitting display as claimed in claim 1, wherein the pixels on the even line emit light during a non-light emission period (a first frame period) of the pixels on the odd line, and the pixels on the odd line emit light during a non-light emission period (a second frame period) of the pixels on the even line.

3. The organic light emitting display as claimed in claim 1, wherein the scan signal lines are classified into odd and even numbers, and currents from first power source lines different from each other are applied to the organic light emitting diode corresponding to the odd number and the organic light emitting diode corresponding to the even number.

4. The organic light emitting display as claimed in claim 1, wherein the first switching transistor in a pixel circuit on the odd line is turned on during the first frame period and turned off during the second frame period.

5. The organic light emitting display as claimed in claim 1, wherein the first switching transistor in a pixel circuit on the even line is turned off during the first frame period and turned on during the second frame period.

6. The organic light emitting display as claimed in claim 1, wherein the driving transistor in the pixel circuit on the odd line is turned off during the first frame period and turned on during the second frame period.

7. The organic light emitting display as claimed in claim 1, wherein the driving transistor in the pixel circuit on the even line is turned on during the first frame period and turned off during the second frame period.

8. The organic light emitting display as claimed in claim 1, wherein a data voltage and a threshold voltage of the driving transistor are charged in the storage capacitor in the pixel circuit on the odd line during the first frame period and discharged during the second frame period to make the current to flow in the organic light emitting diode.

9. The organic light emitting display as claimed in claim 1, wherein the storage capacitor in the pixel circuit on the even line is discharged during the first frame period to make the current to flow in the organic light emitting diode and a data voltage and a threshold voltage of the driving transistor are charged in the storage capacitor during the second frame period.

10. The organic light emitting display as claimed in claim 1, wherein a reverse bias voltage is applied to the organic light emitting diode in the pixel circuit on the odd line during the first frame period and a current in a forward direction flows therein to emit light during the second frame period.

11. The organic light emitting display as claimed in claim 1, wherein a current in a forward direction flows in the organic light emitting diode in the pixel circuit on the even line to emit light during the first frame period and a reverse bias voltage is applied to thereto during the second frame period.

12. The organic light emitting display as claimed in claim 1, wherein the switching transistor for applying a reverse bias in the pixel circuit on the odd line is turned on during the first frame period and turned off during the second frame period.

13. The organic light emitting display as claimed in claim 1, wherein the switching transistor for applying a reverse bias in the pixel circuit on the even line is turned off during the first frame period and turned on during the second frame period.

14. The organic light emitting display as claimed in claim 1, wherein a second switching transistor is coupled between the first power source line and the first switching transistor.

15. The organic light emitting display as claimed in claim 1, wherein a third switching transistor is coupled between the driving transistor and the organic light emitting diode.

16. The organic light emitting display as claimed in claim 1, wherein a fourth switching transistor is coupled between a control electrode and a drain electrode of the driving transistor and the scan signal line is coupled to a control electrode of the fourth switching transistor.

17. The organic light emitting display as claimed in claim 1, wherein a second switching transistor is coupled between the first power source line and the first switching transistor, the third switching transistor is coupled between the driving transistor and the organic light emitting diode, the fourth switching transistor is coupled between the control electrode and the drain electrode of the driving transistor, and the scan signal line is coupled to the control electrode of the fourth switching transistor.

18. The organic light emitting display as claimed in claim 17, wherein the second switching transistor in the pixel circuit on the odd line is turned off during the first frame period and turned on during the second frame period.

19. The organic light emitting display as claimed in claim 17, wherein the second switching transistor in the pixel circuit on the even line is turned on during the first frame period and turned off during the second frame period.

20. The organic light emitting display as claimed in claim 17, wherein the third switching transistor in the pixel circuit on the odd line is turned off during the first frame period and turned on during the second frame period.

21. The organic light emitting display as claimed in claim 17, wherein the third switching transistor in the pixel circuit on the even line is turned on during the first frame period and turned off during the second frame period.

22. The organic light emitting display as claimed in claim 17, wherein the fourth switching transistor in the pixel circuit on the odd line is turned on during the first frame period and turned off during the second frame period.

23. The organic light emitting display as claimed in claim 17, wherein the fourth switching transistor in the pixel circuit on the even line is turned off during the first frame period and turned on during the second frame period.

24. The organic light emitting display as claimed in claim 1, wherein a control electrode of the first switching transistor is coupled to the scan signal line and the first switching transistor is coupled between the data line and the first power source line.

25. The organic light emitting display as claimed in claim 1, wherein the driving transistor is coupled between the first power source line and the second power source line.

26. The organic light emitting display as claimed in claim 1, wherein the storage capacitor is coupled between the first power source line and the initial power source line.

27. The organic light emitting display as claimed in claim 1, wherein a control electrode of the initial switching transistor is coupled to a previous scan signal line and the initial switching transistor is coupled between the first power source line and the initial power source line.

28. The organic light emitting display as claimed in claim 1, wherein the switching transistor for applying a reverse bias is coupled between an anode of the organic line emitting diode and the initial power source line.

29. The organic light emitting display as claimed in claim 1, wherein a first electrode of the switching transistor is coupled to the anode of the organic light emitting diode and a second electrode of the third switching transistor, and a second electrode of the switching transistor is coupled to the initial power source line.

30. The organic light emitting display as claimed in claim 1, wherein the anode of the organic light emitting diode is coupled to the first power source line and a cathode thereof is coupled to the second power source line.

31. The organic light emitting display as claimed in claim 17, wherein a control electrode of the second switching transistor is coupled to the emission control signal line and the second switching transistor is coupled between the first power source line and the data line.

32. The organic light emitting display as claimed in claim 17, wherein a control electrode of the third switching transistor is coupled to the control electrode of the second switching transistor and the third switching transistor is coupled between the first power source line and the second power source line.

33. The organic light emitting display as claimed in claim 17, wherein the second power source line is coupled to the cathode of the organic light emitting diode and a second power voltage of the second power source line is greater than an initial power voltage of the initial power source line.

34. A driving method of an organic light emitting diode display, wherein all pixels in a panel (an image display unit) are classified into an odd line and an even line in the horizontal direction, wherein a first power source line for the odd line is coupled to the pixels on the odd line, wherein a first power source line for the even line is coupled to the pixels on the even line, wherein the driving method repeatedly executes a first frame period and a second frame period to display an image, wherein, in the first frame period, the pixel on the even (or odd) line writes data and, simultaneously, applies a reverse bias voltage to the organic light emitting diode using a switching transistor coupled between a second power source line and an initial power source line, a control electrode of the switching transistor is coupled to an emission reverse control signal line, the emission reverse control signal line is an inverted signal of an emission control signal line, while the pixel on the odd (or even) line emits light, and wherein, in the second frame period, the pixel on the even (or odd) line emits light, while the pixel on the odd (or even) line writes data and, simultaneously, applies a reverse bias voltage to the organic light emitting diode using the switching transistor coupled between the second power source line and the initial power source line, the control electrode of the switching transistor is coupled to the emission reverse control signal line, the emission reverse control signal line is the inverted signal of the emission control signal line.

* * * * *